US008113453B2

(12) United States Patent
Bardos

(10) Patent No.: US 8,113,453 B2
(45) Date of Patent: Feb. 14, 2012

(54) REDUCING MACHINE ROTOR ASSEMBLY AND METHODS OF CONSTRUCTING AND OPERATING THE SAME

(75) Inventor: Gary M. Bardos, Remus, MI (US)

(73) Assignee: Morbark, Inc., Winn, MI (US)

( * ) Notice: Subject to any disclaimer, the term of this patent is extended or adjusted under 35 U.S.C. 154(b) by 164 days.

(21) Appl. No.: 12/625,105

(22) Filed: Nov. 24, 2009

(65) Prior Publication Data

US 2010/0096483 A1 Apr. 22, 2010

Related U.S. Application Data

(60) Division of application No. 11/329,662, filed on Jan. 11, 2006, now Pat. No. 7,624,490, and a division of application No. 10/774,548, filed on Feb. 9, 2004, now Pat. No. 7,055,770, which is a continuation-in-part of application No. 09/846,937, filed on May 1, 2001, now Pat. No. 6,880,774.

(60) Provisional application No. 60/246,862, filed on Nov. 8, 2000, provisional application No. 60/203,241, filed on May 8, 2000, provisional application No. 60/446,143, filed on Feb. 10, 2003.

(51) Int. Cl.
*B02C 13/28* (2006.01)

(52) U.S. Cl. ..... 241/189.1; 241/195; 241/197; 241/294

(58) Field of Classification Search ..... 241/189.1, 241/194, 195, 197, 294
See application file for complete search history.

(56) References Cited

U.S. PATENT DOCUMENTS

| | | | | |
|---|---|---|---|---|
| 286,630 | A | 10/1883 | Orton | |
| 389,139 | A | 9/1888 | Dumontier | |
| 486,901 | A | 11/1892 | Shimer | |
| 824,589 | A | 6/1906 | Ruth et al. | |
| 1,413,611 | A * | 4/1922 | Plaisted | 241/194 |
| 2,865,572 | A | 12/1958 | Lannert | |
| 2,986,347 | A | 5/1961 | Stevenson | |
| 3,547,360 | A | 12/1970 | Sherman, Jr. | |
| 3,642,212 | A | 2/1972 | Voit | |
| 3,642,214 | A | 2/1972 | Blackwell, Jr. | |
| 3,818,561 | A | 6/1974 | Montana et al. | |
| 3,876,158 | A | 4/1975 | Rogers | |
| 4,205,799 | A | 6/1980 | Brewer | |
| 4,628,976 | A | 12/1986 | Loring | |
| 4,892,260 | A | 1/1990 | Hager | |
| 4,915,309 | A | 4/1990 | Schmidt | |
| 5,070,920 | A | 12/1991 | Morey | |
| 5,148,844 | A | 9/1992 | Robison | |
| 5,271,440 | A | 12/1993 | Bradstreet, Jr. et al. | |
| 5,307,719 | A | 5/1994 | MacLennan | |
| 5,372,316 | A | 12/1994 | Bateman | |

(Continued)

*Primary Examiner* — Mark Rosenbaum
(74) *Attorney, Agent, or Firm* — Reising Ethington P.C.

(57) ABSTRACT

A fragmenting rotor assembly for comminuting waste wood and other fragmentable material. A hammer support is carried by a drive shaft driven in rotation about a longitudinal drive shaft axis. The hammer support projects radially relative to the drive shaft axis and includes a radially outer hammer head. A fragmenting knife is removably secured to the hammer head and has a reducing edge disposed in a radially outer cutting position. A deflecting member is carried by the drive shaft and has a radially outer end that deflects fragments away from at least a portion of the fragmenting knife. The hammer support and/or the deflecting member are carried by at least one rod of a plurality of circumferentially-spaced axially-extending rods that are carried on the drive shaft by axially-spaced rotor members.

15 Claims, 22 Drawing Sheets

U.S. PATENT DOCUMENTS

| | | | | |
|---|---|---|---|---|
| 5,379,951 | A | 1/1995 | Hughes | |
| 5,409,047 | A | 4/1995 | Jorgensen | |
| 5,419,502 | A | 5/1995 | Morey | |
| 5,497,950 | A | 3/1996 | Schrodl | |
| 5,713,525 | A | 2/1998 | Morey | |
| 5,967,436 | A | 10/1999 | Balvanz | |
| 6,059,210 | A | 5/2000 | Smith | |
| 6,142,400 | A | 11/2000 | Balvanz et al. | |
| 7,055,770 | B2 * | 6/2006 | Bardos | 241/189.1 |

* cited by examiner

REDUCING MACHINE ROTOR ASSEMBLY AND METHODS OF CONSTRUCTING AND OPERATING THE SAME

This application is a divisional application of application, Ser. No. 11/329,662 filed on Jan. 11, 2006 now U.S. Pat. No. 7,624,490, and claims the priority thereof, and Ser. No. 10/774,548 filed on Feb. 9, 2004 now U.S. Pat. No. 7,055,770 and claims the priority thereof, which is a continuation in part of application, Ser. No. 09/846,937 filed May 1, 2001 now U.S. Pat. No. 6,880,774 and claims the priority thereof and of provisional application Ser. No. 60/203,241 filed May 8, 2000, and also the priority of provisional application Ser. No. 60/246,862 filed Nov. 8, 2000. The application also claims the priority of provisional application Ser. No. 60/446,143 filed Feb. 10, 2003. This invention relates to rotor assemblies for heavy machinery such as hammer mills and wood hogs for fragmenting waste wood and other products, including demolition debris, stumps, pallets, large timbers, and the like into particulate or chips which are useful, for example, as mulch, groundcover, and fuel.

BACKGROUND OF THE INVENTION

The present invention is directed to improved rotor constructions of rugged and durable character. The present assignee owns U.S. Pat. No. 5,713,525, issued Feb. 3, 1998, for a typical wood hog machine and U.S. Pat. No. 5,419,502, issued May 30, 1995, for a typical tub grinder hammer mill system. Both patents are incorporated herein by reference. The rotor assemblies of the present invention are usable with either type of machine. A cutter tooth assembly for such machines is also disclosed in U.S. Pat. No. 3,642,212 (also incorporated herein by reference), issued Feb. 15, 1972, for a cutter tooth assembly for such grinders or fragmenters.

Such machines, which usually comprise a rotor having a plurality of teeth that pass through openings formed in anvils or the like, and wear rapidly, must be replaced frequently. As the teeth of the rotor wear, their cutting edges become rounded or blunted and less effective in their grinding or cutting function. When in use in the field, a considerable supply of replacement cutting teeth must be maintained.

The present rotor assembly is particularly constructed to overcome some of the difficulties experienced with prior art machinery and utilizes longer lived cutters. The construction in some forms also utilizes separately replaceable deflecting lobes or humps which extend radially and new methods of constructing and operating rotor assemblies.

SUMMARY OF THE INVENTION

According to the invention a method is provided for making a fragmenting rotor assembly operable with an anvil surface for comminuting waste wood and other fragmentable material. The method includes providing a drive shaft and mechanism for driving the shaft in a direction of rotation; supporting a plurality of rotor members in axially-spaced relationship along the drive shaft; supporting a series of circumferentially-spaced axially extending rods on and extending between the rotor members; providing a series of radially projecting hammer supports having radially outer hammer heads, the hammer supports being spaced along a rotational axis of the shaft and carried by the rods; providing fragmenting knives that each have a reducing edge, and that are removably secured to respective ones of the hammer heads such that the reducing edge of each knife is positioned in a radially outer cutting position; and supporting a plurality of deflecting members on the rods such that radially outer ends of the deflecting members are disposed in respective positions to deflect wood fragments away from at least portions of fragmenting knives carried by respective hammer heads.

Alternatively, the method may include mounting separately replaceable deflecting members independently of the hammer heads and radially between pairs of hammer heads, the deflecting members having outer ends moving in circumferential paths of lesser radial extent than corresponding circumferential paths of the knife edges; the deflecting members being provided as generally oblong bodies with a central portion and with lobular outer ends, and providing the hammer heads and deflecting members in helically staggered relation along the axis of the shaft with each deflecting member lobular end in radial plane alignment with a hammer knife.

Alternatively, the method may include mounting separately replaceable deflecting members independently of the hammer heads and radially between pairs of hammer heads, the deflecting members having outer ends moving in circumferential paths of lesser radial extent than corresponding circumferential paths of the knife edges; providing discs in axially spaced relationship along the drive shaft; and mounting the hammer heads angularly at the sides of the discs so that the knives thereon are of such axial extent that their paths of annular travel axially overlap without interfering.

Alternatively, the method may include mounting separately replaceable deflecting members independently of the hammer heads and radially between pairs of hammer heads, the deflecting members having outer ends moving in circumferential paths of lesser radial extent than corresponding circumferential paths of the knife edges; providing discs in axially-spaced relationship along the drive shaft; and securing the knives of hammer heads disposed on opposite sides of the same disc in circumferentially displaced positions having a rotary path of axial overlap.

Alternatively, the method may include mounting a deflecting member in substantially axial alignment with a hammer support and reversing the hammer support side for side when it becomes worn.

Alternatively, the method may include providing discs in axially-spaced relationship along the drive shaft, mounting a series of circumferentially spaced axially extending pairs of rods to extend between the discs, and mounting the hammer heads and deflecting members releasably on the rods to extend between the pairs of rods in radially alternating relation.

Alternatively, the method may include providing a fragmenting knife having two reducing edges and removably secured to the rotatively leading portions of a hammer head such that one reducing edge of the a fragmenting knife is positioned in a radially outer cutting position and the other reducing edge is positioned in a radially inner stowed position. Further according to this alternative, a deflecting member may be mounted such that a radially outer end of the a deflecting member is positioned to move in circumferential deflecting path radially beyond a circumferential path of the fragmenting knife reducing edge carried in the inner stowed position on the a hammer head and within a circumferential cutting path of the fragmenting knife reducing edge carried in the outer cutting position on the a hammer head to deflect wood fragments away from the fragmenting knife reducing edge in the inner stowed position without impeding the cutting path of the fragmenting knife reducing edge in the outer cutting position.

Alternatively, the step of supporting at least one deflecting member on the drive shaft may include supporting the at least one deflecting member such that its radially outer end is disposed adjacent a radial plane of rotation of the at least one hammer support.

Alternatively, the step of supporting at least one deflecting member on the drive shaft may include supporting the at least one deflecting member such that its radially outer end is disposed in the radial plane of rotation of the at least one hammer support.

Alternatively, the step of supporting at least one deflecting member on the drive shaft may include supporting a plurality of deflecting members on the drive shaft in a helically staggered relationship along the shaft axis.

According to the invention a fragmenting rotor assembly may be provided for comminuting waste wood and other fragmentable material. The assembly may comprise a drive shaft and mechanism for driving the drive shaft in a direction of rotation about a longitudinal drive shaft axis, a hammer support carried by the drive shaft and projecting radially relative to the drive shaft axis and including a radially outer hammer head, a fragmenting knife removably secured to the hammer head and having a reducing edge disposed in a radially outer cutting position, and a deflecting member carried by the drive shaft and having a radially outer end disposed in a position and configured to deflect fragments away from at least a portion of the fragmenting knife, at least one of the hammer support and the deflecting member being carried by at least one rod of a plurality of circumferentially-spaced axially-extending rods that are carried on the drive shaft by axially-spaced rotor members.

Alternatively, the deflecting member may be disposed adjacent a radial plane of rotation of the hammer head for motion in a circumferential deflecting path radially short of a circumferential cutting path of the reducing edge of the fragmenting knife carried by the hammer head and radially beyond a circumferential path of at least a radially inner portion of the fragmenting knife extending a radial distance short of the radial distance to the fragmenting knife reducing edge.

Alternatively, the fragmenting knife may have a second reducing edge and may be removably secured to the hammer head such that one of the reducing edges of the knife is positioned in a radially outer cutting position and the other reducing edge of the knife is positioned in a radially inner stowed position relative to the drive shaft axis of rotation, and the radially outer end of the deflecting member is positioned to move in a circumferential deflecting path radially beyond a circumferential path of the fragmenting knife reducing edge carried in the inner stowed position on the hammer head.

Alternatively, the deflecting member may be disposed in the radial plane of rotation of the hammer head.

Alternatively, the radially outer end of the deflecting member may be positioned to move in a circumferential deflecting path radially beyond a circumferential path of one or more bolts holding the fragmenting knife to the hammer head.

Alternatively, the deflecting member may have a generally oblong body with a lobular outer end.

Alternatively, a plurality of hammer supports and deflecting members may be carried by the rods on the drive shaft and may be driven in rotation by the drive shaft, a plurality of fragmenting knives may be removably secured to each hammer head of the plurality of hammer supports and may have respective reducing edges disposed in respective radially outer cutting positions, and the deflecting members may have radially outer ends disposed in respective positions to deflect fragments away from at least portions of respective fragmenting knives.

Alternatively, the deflecting members may be supported in helically staggered positions with respect to the rotational axis of the drive shaft.

Alternatively, the hammer support may be side-for-side reversible.

Alternatively, the hammer support and the deflecting member may each be carried by at least one rod of the plurality of circumferentially-spaced axially-extending rods.

Alternatively, the hammer support may be carried by two rods of the plurality of rods and the deflecting member may be carried by two rods of the plurality of rods, and at least one of the rods carrying the deflecting member may be disposed circumferentially adjacent and rotatively preceding at least one of the two rods carrying the deflecting member.

Alternatively, both rods carrying the deflecting member may rotatively precede both rods carrying the hammer support.

Alternatively, the hammer support may include two axial through-holes configured to receive two rods of the plurality of axially-extending rods.

Alternatively, the deflector member may include two axial through-holes configured to receive two rods of the plurality of axially-extending rods.

Alternatively, the hammer support may be carried between two axially adjacent rotor members and the deflecting member may be carried between the same two axially adjacent rotor members.

Alternatively, the deflecting member may be spaced radially between the hammer support and a second hammer support may be carried between the same two axially adjacent rotor members.

Alternatively, the deflecting member may be disposed adjacent a radial plane of rotation of at least one of the two hammer supports carried between the same two axially adjacent rotor members.

Alternatively, at least a portion of the deflecting member may be disposed in the radial plane of rotation of at least one of the two hammer supports.

Other aspects of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DETAILED DESCRIPTION

Figure 1:
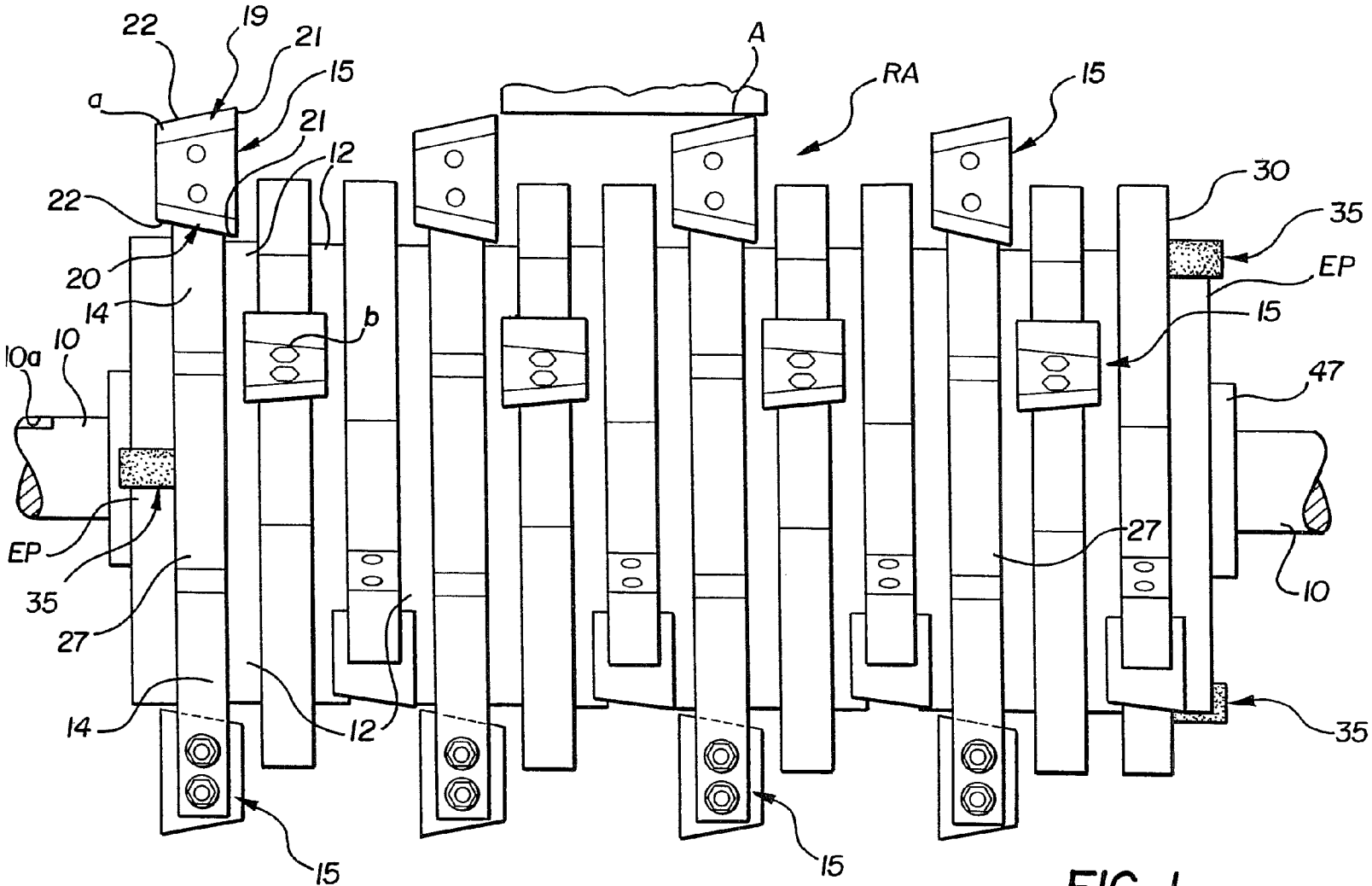
FIG. 1 is a schematic plan view of the rotor assembly.
Figure 2:
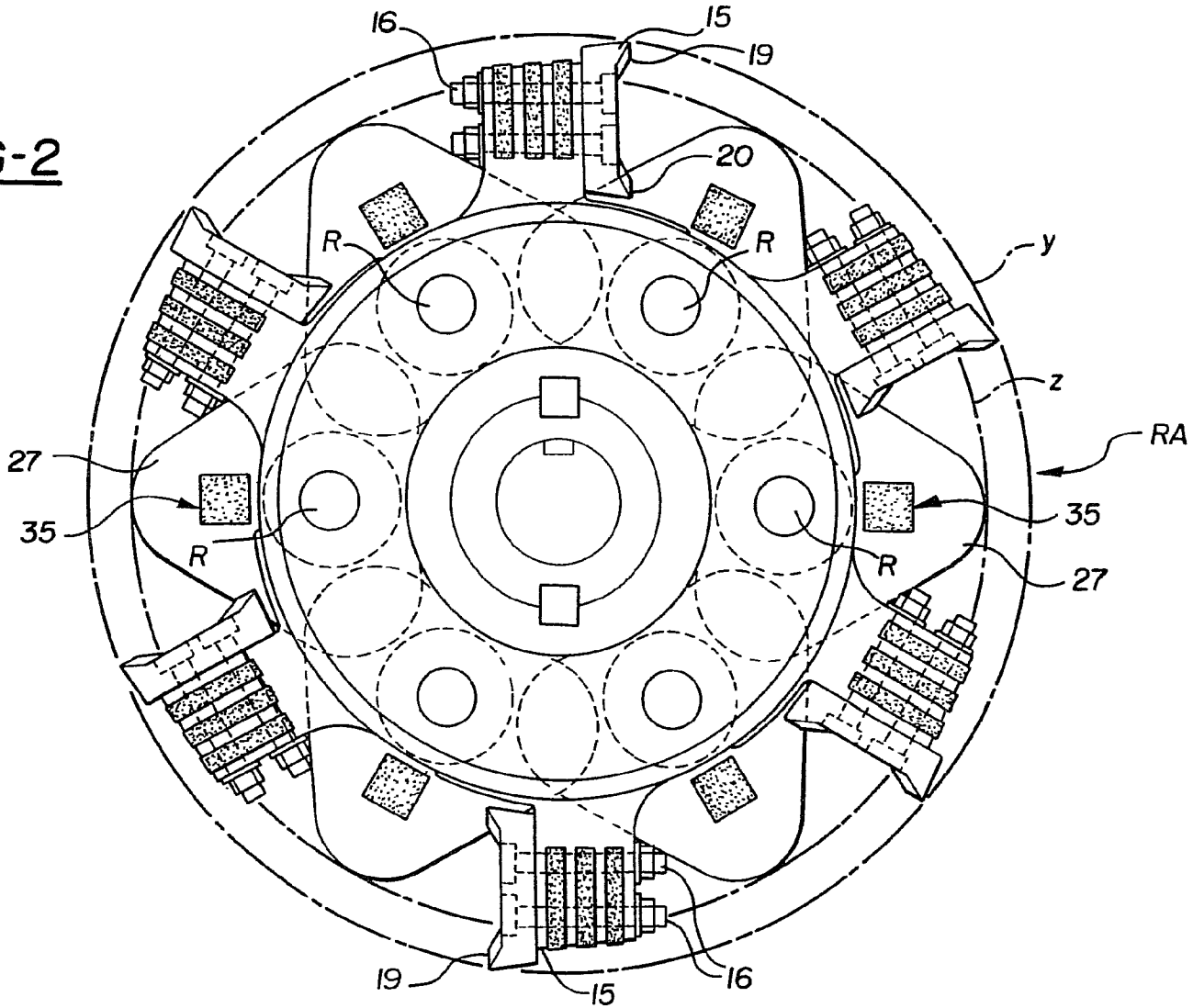
FIG. 2 is an end elevational view thereof.
Figure 3:
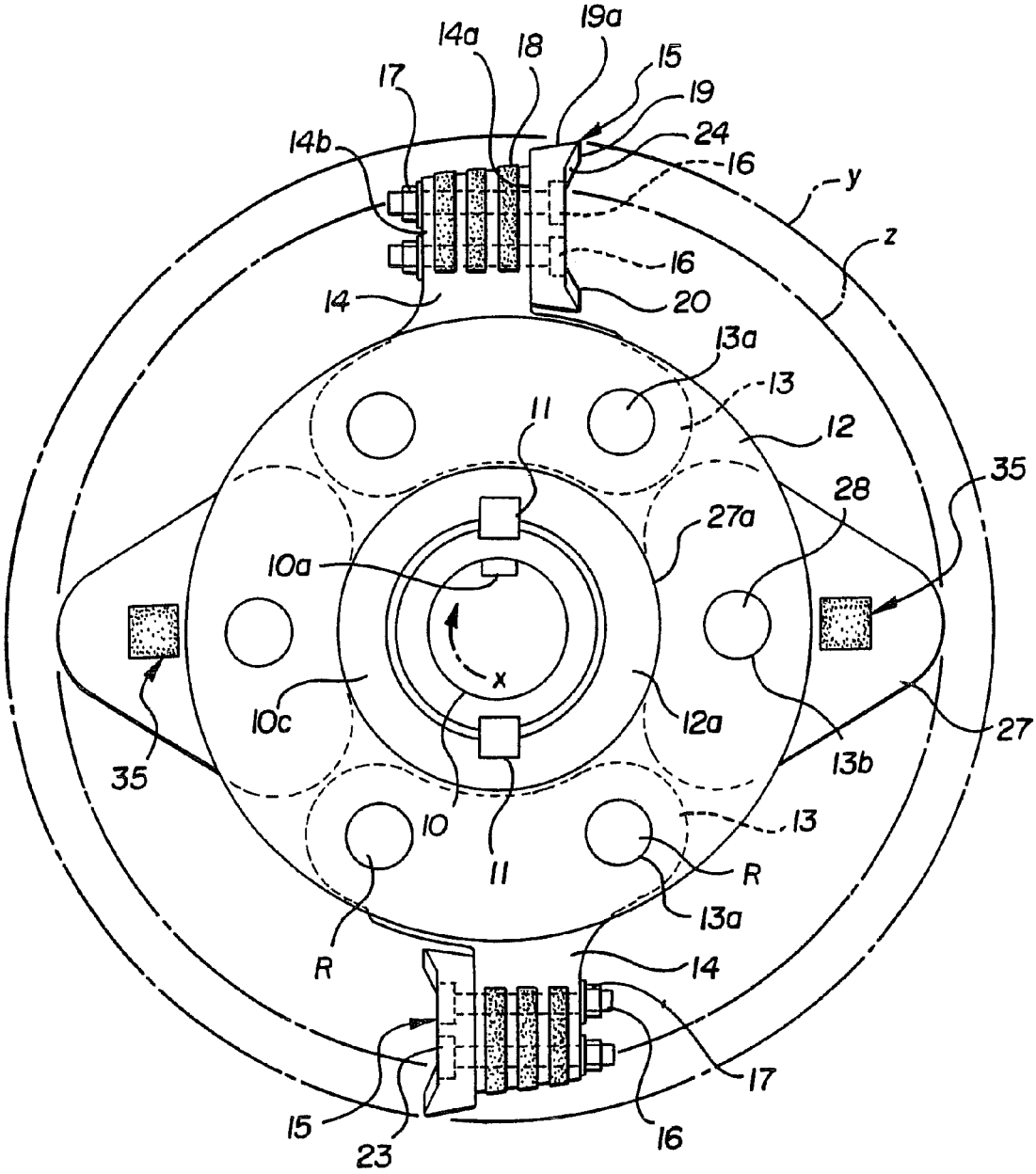
FIG. 3 is a schematic end elevational view of a single rotor disc only with pairs of hammers and lobes mounted thereon.

Referring now more particularly to FIGS. 1-47 of the accompanying drawings and in the first instance to FIGS. 1-3, the rotor assembly illustrated is generally designated RA and comprises a shaft 10 which may have a keyway 10*a* by means of which it is coupled to a drive motor. Typically the drive, in addition to keyway 10*a*, may comprise sprockets and chains, or sheaves and belts, coupled to a drive motor such as a diesel engine. The rotor assembly RA in all embodiments to be disclosed may be employed in any suitable wood comminuting machine such as the hammer mill disclosed in the aforementioned U.S. Pat. No. 5,419,402 or the wood hog disclosed in the aforementioned U.S. Pat. No. 5,713,525.

Keyed to an enlarged portion 10*c* of the shaft 10 as, for example, at 11, may be rotors 12*a* for axially adjacent discs or rotor plates 12 between which radially opposite hammer bodies or supports 13 may be mounted on circumferentially spaced axially extending rods R extending through opening 13*a* in the hammer bodies and 13*b* in the discs 12. In the embodiment shown, discs or plates 12 will have six circumferentially spaced openings 13*b* to snugly slideably receive the mounting rods R. FIGS. 19-22 illustrate the manner in which the rods R may be releasably locked in position and will later be specifically described. The hammer bodies 13 (FIG. 3) include cutter mounting, radially outer head portions 14 having leading faces 14*a* extending generally radially to the direction of rotation x of the rotor shaft, and trailing faces 14*b*.

Fragmenting or cutting dual edge knives, generally designated 15, to be later described in more detail, may be secured to the hammer heads 14 by a suitable fastening mechanism such as a pair of bolts 16 which extend through bolt openings 16*a* in the cutters 15 and 16*b* in the hammer heads 14 to be secured by nuts 17. It will be noted that the hammer head sides and top or outer surfaces may be coated with bands of a wear material such as tungsten carbide 18.

Referring now more particularly to FIGS. 1 and 4-7, it will be noted that the cutters, generally designated 15, may be provided with radially outer and radially inner fragmenting or cutting edges, generally designated 19 and 20 respectively. The radially outer edges coact with the usual anvil edge A (FIG. 1) to cut and fragment the material. Each of these cutting edges 19 20 may include a radially constant portion 21 (FIG. 4) and a radially inclined portion 22, but, as will be seen, the inclined portions 22 of the respective cutting edges 19, and 20 may incline in opposing directions. Typically, the edge portion 21 (FIG. 4) may be a half-inch in length when the overall axial width of the cutter is 4 inches. It will be noted that the cutter body may be counterbored as at 23 to receive the heads of bolts 16. The angle of inclination of inclined portions 22 may typically be 12° to the surfaces 21.

Figure 4:
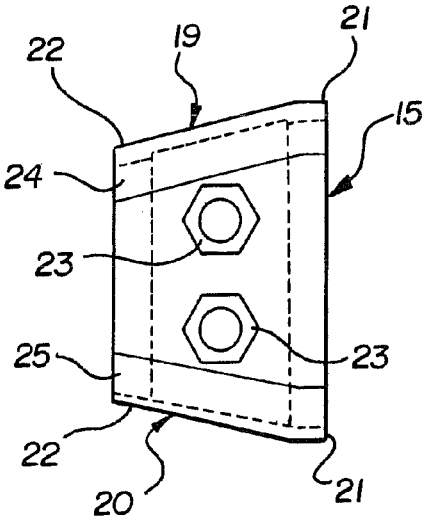
FIG. 4 is a front elevational view of one of the cutter knives only prior to its coating with wear material.
Figure 5:
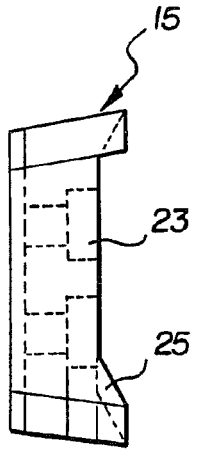
FIG. 5 is an end elevational view thereof.
Figure 6:
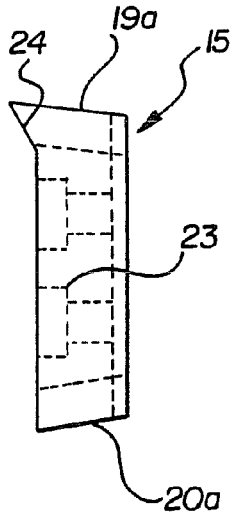
FIG. 6 is an opposite end elevational view thereof.
Figure 7:
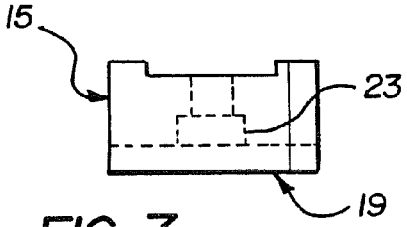
FIG. 7 is a top plan view thereof.
Figure 8:
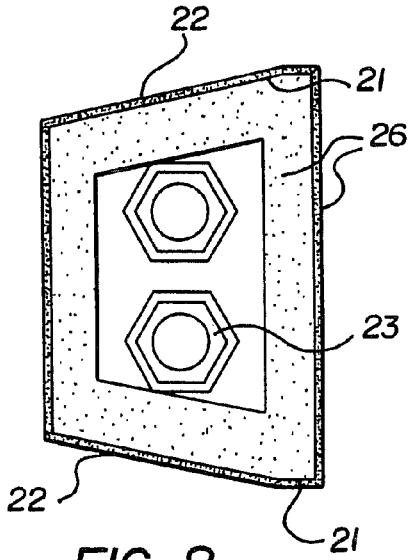
FIG. 8 is a schematic front elevational view of the cutter knife shown in FIG. 4 with the wear surfaces shown as applied thereto.
Figure 9:
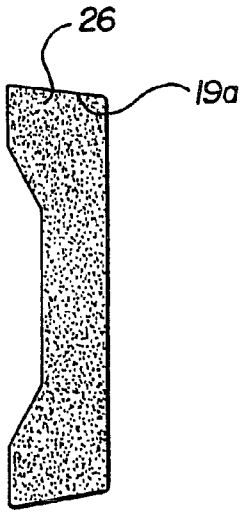
FIG. 9 is an end elevational view thereof.
Figure 10:
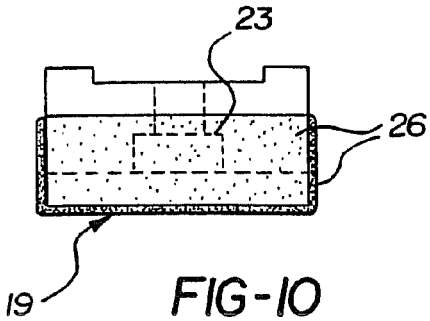
FIG. 10 is a top plan view thereof.

As shown in FIG. 4, by means such as the grinding of the edges 19 a relief face 24 may be formed on the cutter body and by means such as the grinding of the edges 20 a like face 25 may be formed. The relief angle of inclination of the faces 24 and 25 may typically be 28°. It will also be seen that the end edges 21 and 20 may be relieved as at 19*a* and 20*a* and this angle of relief may typically be 8°. As FIGS. 8-10 indicate, the cutters may also provided with a welded-on wear material that may be coated on the cutters as shown in FIGS. 8-10 at 26.

Referring particularly to FIG. 1, it will be noted that the hammers on adjacent discs or rotor plates 12 may be offset angularly with respect to one another in helically staggered relation and that the edges 19 and 20 may project axially beyond the hammer head portions 14 partially across the intervening spacers 12*a*. Thus, the portions 21 of the edges 19 and 20 on axially adjacent hammer heads at their extreme axially projecting edges may revolve in closely adjacent paths of revolution, so that no appreciable space is left between these paths axially. These edges 19 and 20 on the axially adjacent cutters, which are circumferentially closest (adjacent) may be oppositely inclined as shown at a and b in FIG. 1. Because of this, the wood fragments are not progressively forced axially left or right and tend to remain more uniformly dispersed over the length of the cutter head assembly. It will also be observed that the cutters 15 on the axially aligned hammers 13 may have outer cutting edges that incline in opposing directions to provide a more aggressive fragmenting action. In each instance, however, there may be inner edges 20 that are basically held in reserve so that, when the time comes, the knives 15 may simply be rotated 180° once the bolts 16 are removed. The former inner edges will then become the outer "working" edges.

Figure 11:
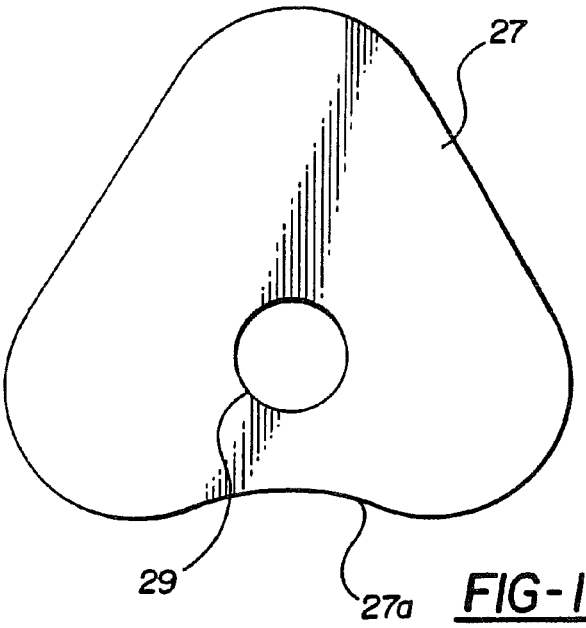
FIG. 11 is a face elevational view of one of the lobes which mount radially between the hammers.
Figure 12:
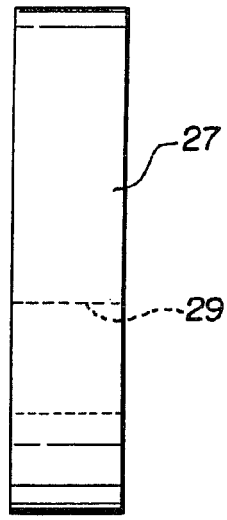
FIG. 12 is an end elevational view thereof.
Figure 13:
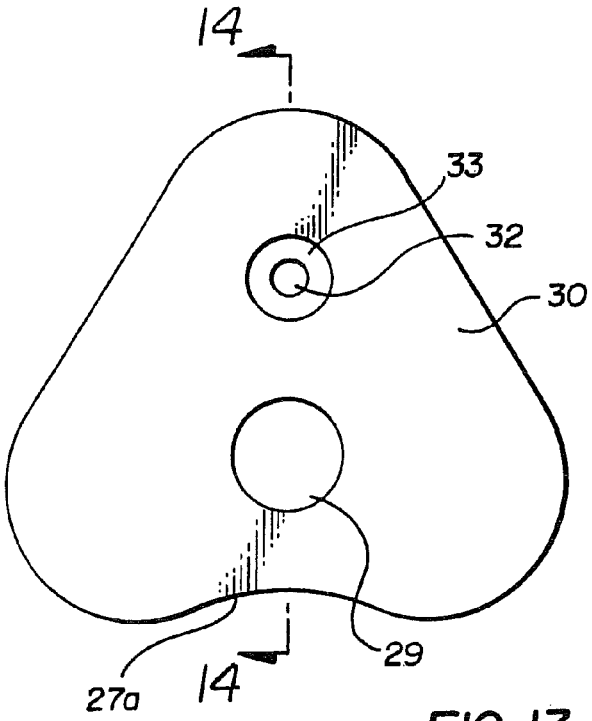
FIG. 13 is a face elevational view of one of the endmost lobes.
Figure 14:
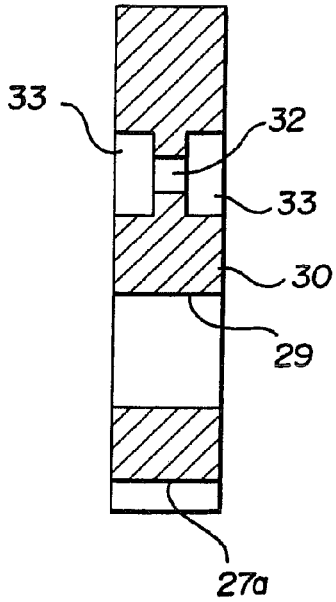
FIG. 14 is a sectional elevational view taken on the line 13-13 of FIG. 13.
Figure 16:
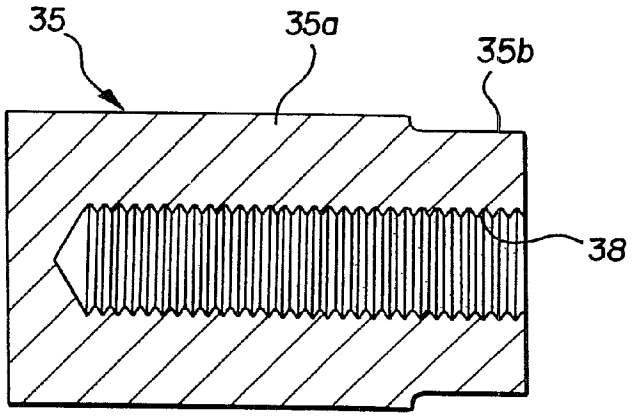
FIG. 16 is a cross-sectional view thereof taken on the line 16-16 of FIG. 15.
Figure 18:
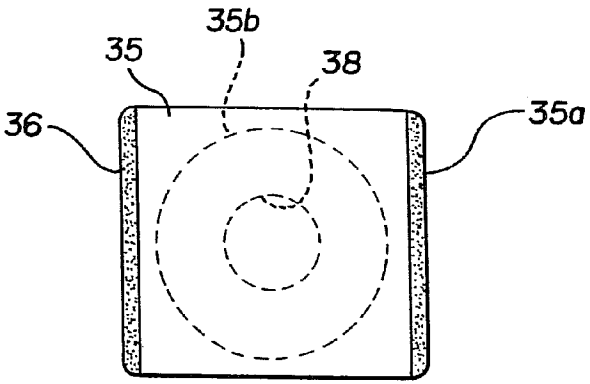
FIG. 18 is an end elevational view thereof.
Figure 15:
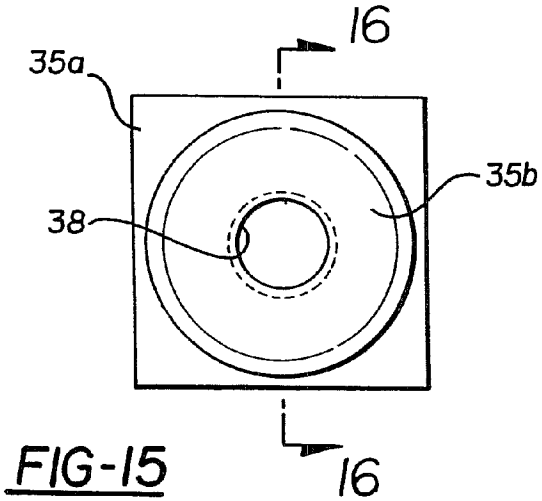
FIG. 15 is an end elevational view of one of the rotor end plate deflect inserts.
Figure 17:
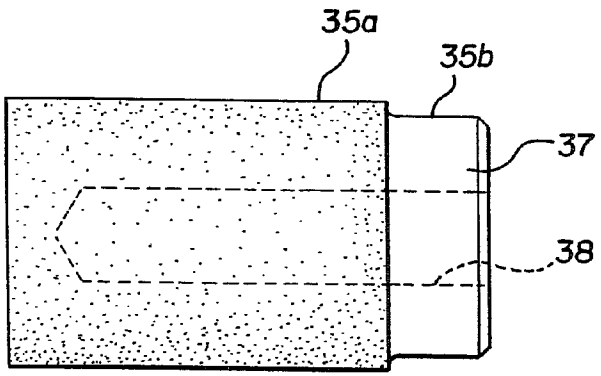
FIG. 17 is a schematic side elevational view of one of the deflect inserts which has been wear material coated.

Lobes or humps 27 of generally delta shape may be provided as shown particularly in FIG. 3. These lobes 27 may be situated radially between adjacent hammer bodies 13. The inner ends of lobes 27 may be curvilinear as at 27*a* to conform to the circumference of the disc hubs 12*a*. As shown in FIGS. 11 and 12, rod openings 29 may be provided in the lobes 27. The distance between a rod opening 29 and one of the openings 13*a* may be the same as the distance between the pair of openings 13*a* in each hammer 13 so that rods R, mounted or supported by discs or plates 12, may mount both the hammers and the lobes in radial alignment, as FIG. 2 indicates.

The interior lobes 27 may be configured as shown in FIGS. 11 and 12. The endmost lobes, at each end of the rotor assembly, are designated 30, and likewise may have openings 29 to receive and pass the mounting rods R. They also, however, may be provided with openings (FIGS. 13 and 14) comprising bores 32 and counterbores 33. Provided to be received in the openings may be screening or deflecting inserts, generally designated 35 (see FIGS. 15 through 18), which comprise square shaped bodies 35*a* that may have wear surface-coated sides 36 as shown. The bodies 35 may have cylindrical portions 35*b* that are received in one of the openings 33 and can be secured by screws extending from the opposing opening 33 and threaded into bolt openings 38 in inserts 35.

As FIG. 1 particularly points out, the purpose of the inserts 35 may be to project axially across the rod-locking end plate assemblies generally designated EP and furnish wear material coated surfaces for engaging the work and radially protecting or screening the end plate assemblies EP.

Figure 20:
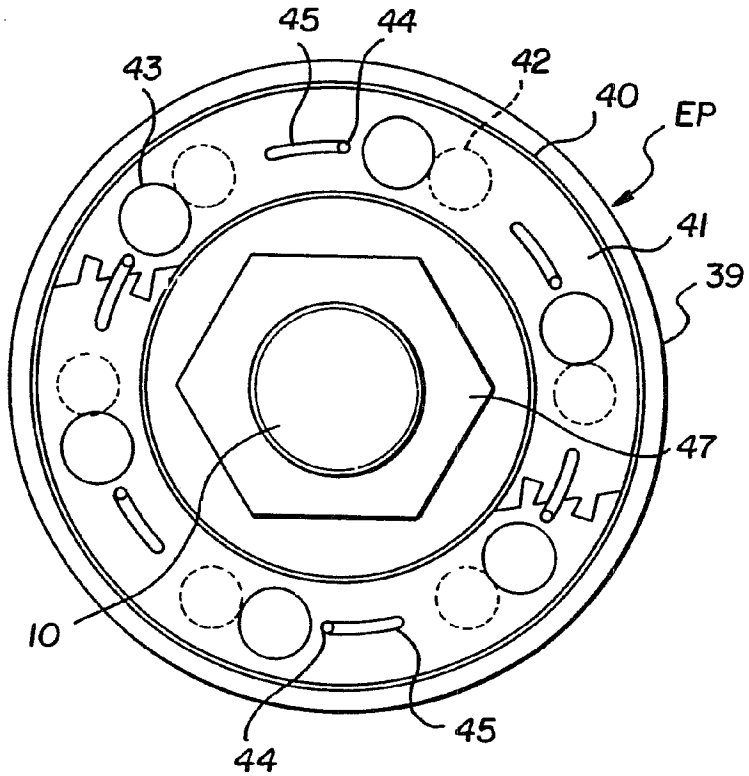
FIG. 20 is an end elevational view thereof.
Figure 19:
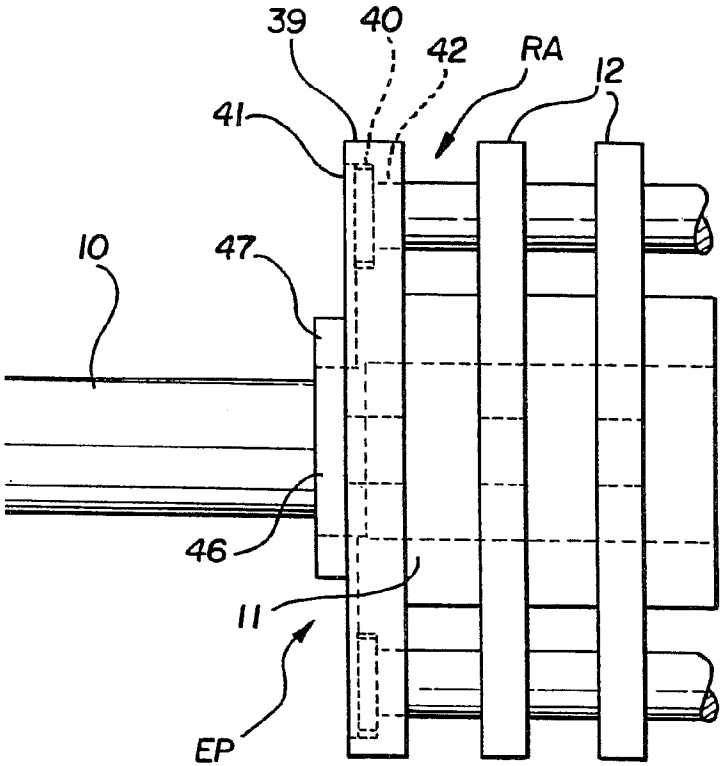
FIG. 19 is a fragmentary plan view of one end of the rotor shaft assembly showing the locking plate in rod locking position, certain parts of the assembly being omitted in the interests of clarify.
Figure 22:
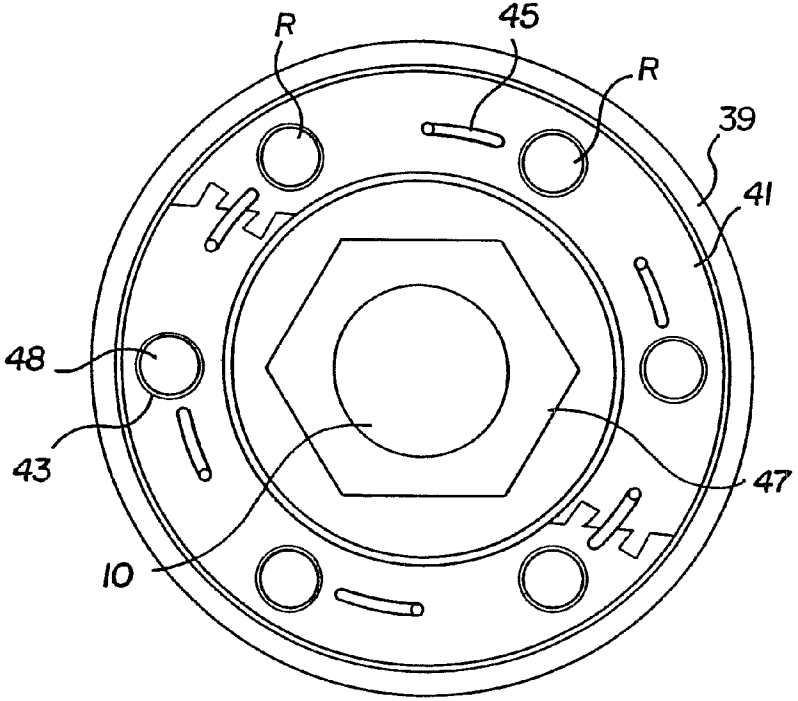
FIG. 22 illustrates an unlocked position of the locking plate.
Figure 21:
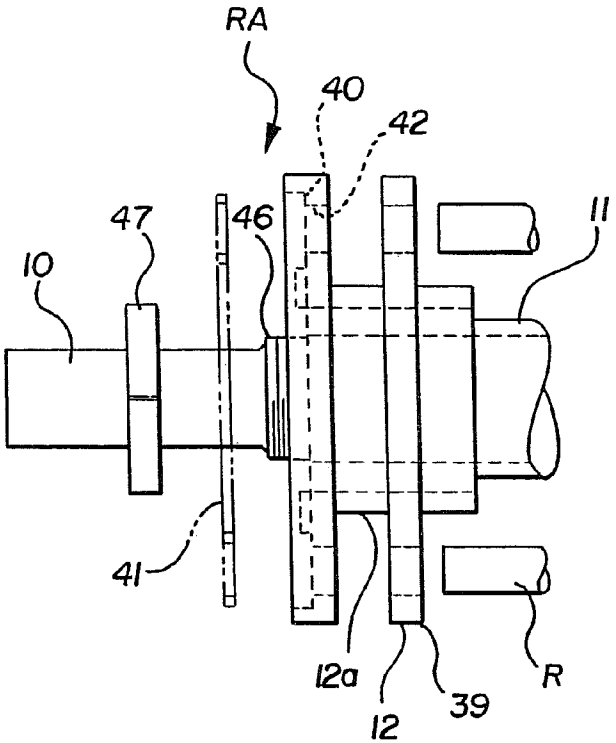
FIG. 21 is an exploded reduced scale plan view of parts illustrated in FIG. 19.
Figure 23:
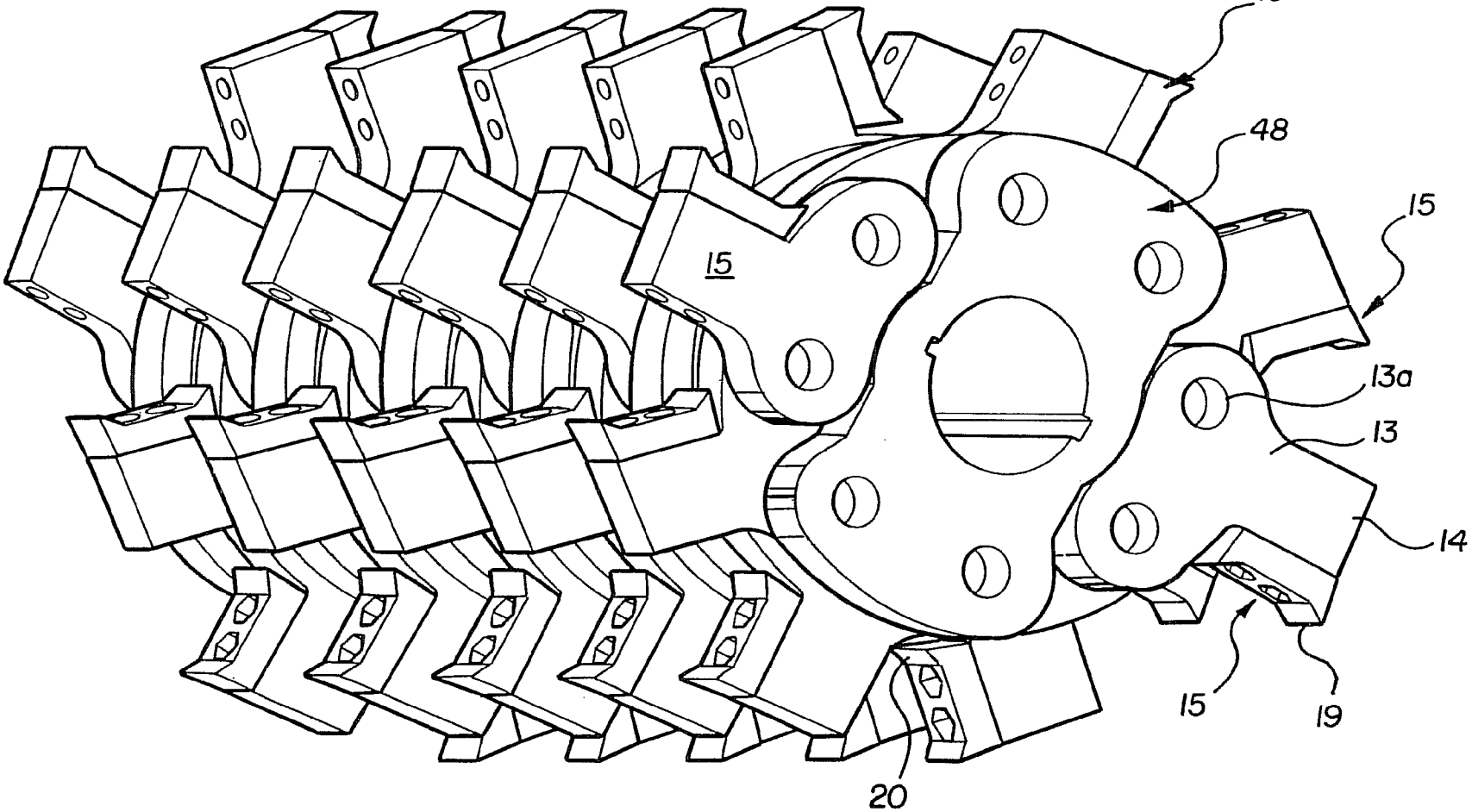
FIG. 23 is a schematic side elevational perspective view of a modified rotor assembly, certain parts being omitted in the interests of clarity.
Figure 26:
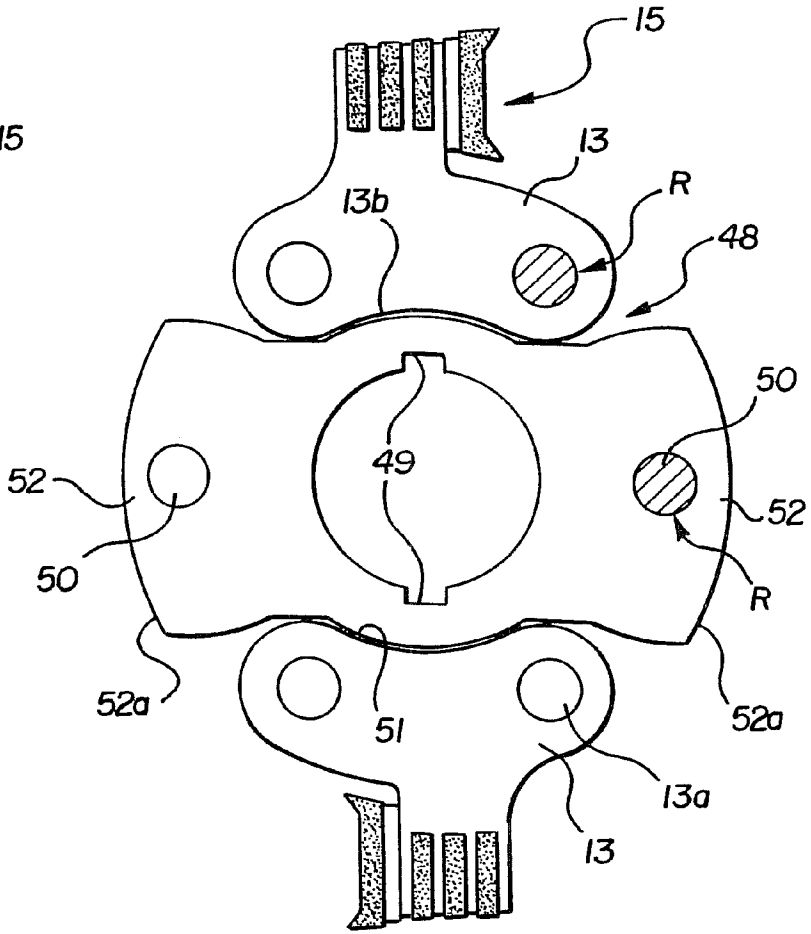
FIG. 26 is a fragmentary end elevational view of one of the rotor disc assemblies only.
Figure 24:
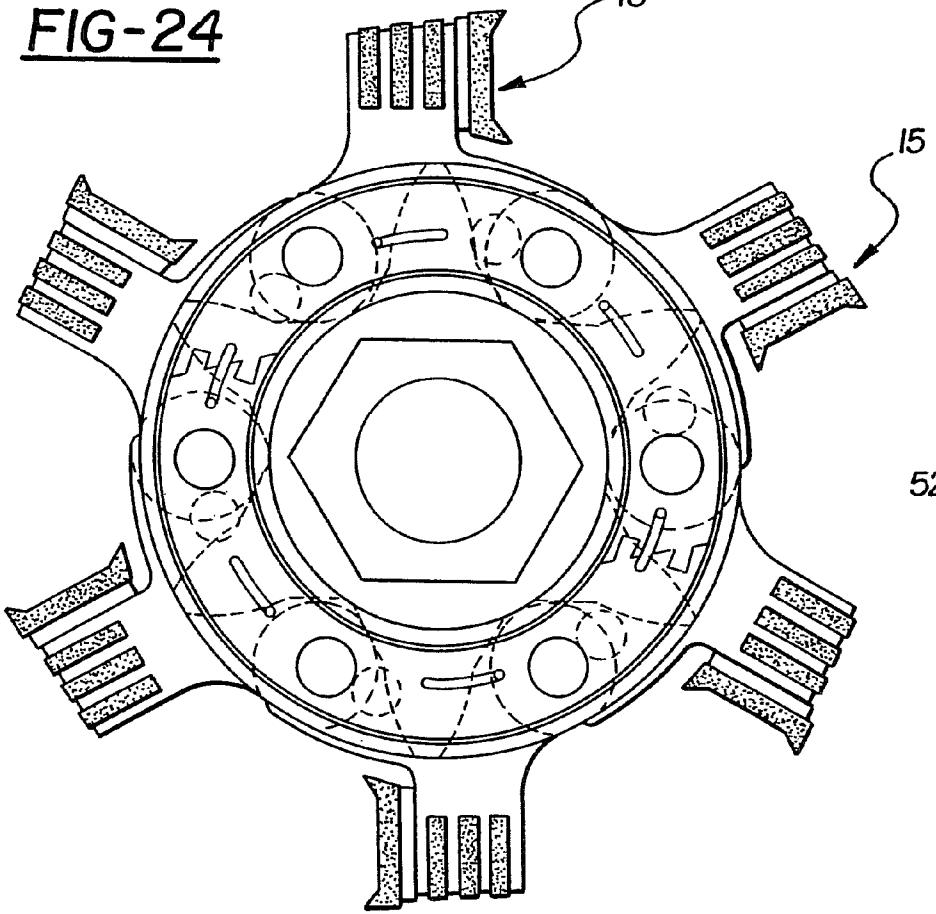
FIG. 24 is an enlarged end elevational view.

Referring now to FIGS. 19-22, each end plate assembly EP may include an end plate 39 having an outwardly facing cavity or recess 40 in which a locking plate or ring disk 41 may be received for limited rotary adjustment. The end plates 39 may have bores 42 for passing rods R and locking plates 41 having identically circumferentially spaced bores 43 which in the rod-releasing position (FIG. 22) can be aligned with bores 42. FIG. 20 illustrates a rod-locking position in which the locking plates 41 have been rotated slightly to block endwise removal of the rods R. Circumferentially spaced bolts 44 projecting endwisely through end plates 39 may also pass through arcuate slots 45 and may have nuts to fix the rotary adjustment of the locking plates 41. It will be seen that the ends of shaft 10 may have threaded portions 46 that releasably receive lock nuts 47 for fixing the plates 39 in locked position.

In operation, the assembled rotor assemblies may be provided in either a wood hog or a hammer mill, such as a tub grinder hammer mill, for example, and driven in the direction of rotation x. When the outer radial edges 19 of the cutters 15 require resharpening, the bolts 16 may be removed and the cutters 15 turned end-for-end to dispose the former inner edges 20 radially outwardly. Obviously, other cutters 15 may be carried in inventory so that the need for trips to the cutter resharpening station can be minimized. The cutting edges 19, which are outermost and may incline in opposite directions on radially in-line hammer heads 14, provide an aggressive cut in a fragmenting operation. With the provision of portions 21, however, there are no points to be readily worn or rounded, as may be the case if the edges 22 were to extend from end-to-end of the cutters 15.

The paths of rotation of the outer knife cutting edges are shown at "y" in FIG. 3. The paths of the outer edges of the lobes or deflectors 27 are shown at "z". It is to be noted that the outer edges of lobes 27 traveling in the paths "z" radially protect the inner edges 20 of each cutter knife 15 during operation, along with also protecting or screening the bolts 16 that hold the cutters 15 in respective fixed positions. Because of the disposition of lobes 27 in or adjacent the radial planes of the knives, wood fragments which might otherwise impinge upon the inner edges 20 and the bolts 16, are deflected in substantial part by the deflector lobes 27.

A further assembly, which is modified in several respects, is disclosed in FIGS. 23-27. Where the parts or assemblies are generally the same as previously described, the same numerals and letters have been used to designate them.

Figure 25:
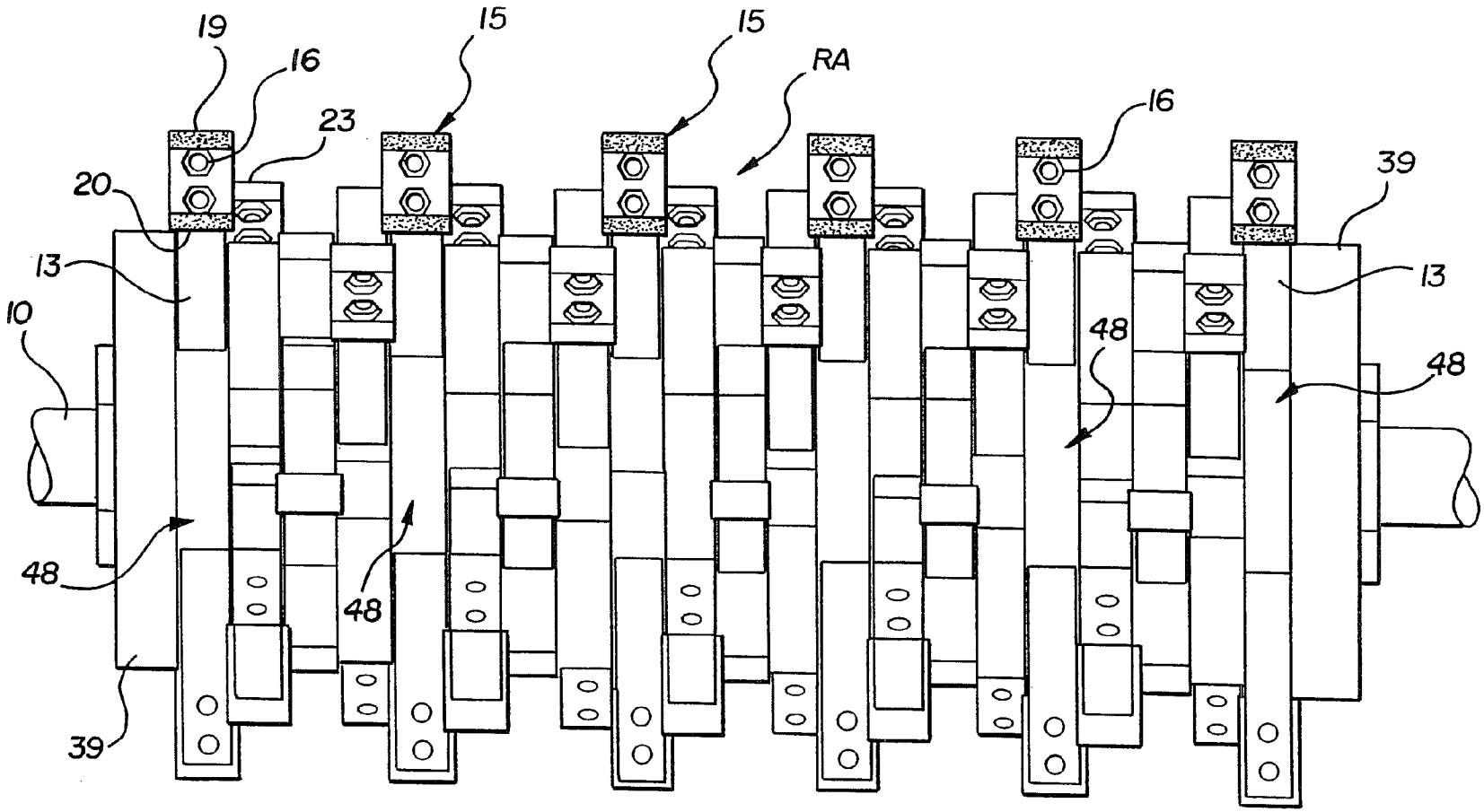
FIG. 25 is a plan view.

In FIG. 25, for example, the overall rotor assembly is similar to the rotor assembly RA disclosed in FIG. 1, and the hammer assemblies 13 are identical. The rotor assembly RA may operate in conjunction with an anvil A of the character disclosed in FIG. 1, and rods R, as previously, may be used to mount the hammer bodies 13 and associated knives 15 in assembled position. The hammer body openings 13*a* may, as previously, be provided along a circle "c" having a constant radius taken from the axis of shaft 10. In the rotor assembly of FIGS. 23-27, however, there are no rotor plates 12 and, as FIG. 25 indicates, the fragmenting and cutting edges 19 and 20, which may be provided on hammer heads 13, may project axially beyond the hammerhead portions 14 to partially axially lap one another. The edges 19 and 20 on the axially adjacent cutters, which are circumferentially closest (adjacent), may not be inclined. The cutter head assembly RA, as previously, may include the rod-locking end plate assemblies EP, including end plates 39 that mount the ends of rod R and the locking plates 41 that lock the removable rods R in position.

In the prior described rotor assembly, the lobes or humps 27 of generally delta-shape may have curvilinear surfaces 27*a* that may be received by the disc hubs 12*a*. In the present case, the delta-shaped lobes may be replaced by dual deflector lobe members, generally designated 48, having keyways 49 or 53, which may secure them on the shaft 10 by way of appropriate keys. Rods R may similarly extend through the openings 50 that may be provided in 180° spaced apart relation along circle "c" in the members 48. It will be noted that the members or deflectors 48 may be shaped such as to provide curvilinear surfaces 51 that match the curvilinear surfaces 13*b* of the hammer bodies 13 on which they are received, and that the screening members 48 may also provided with radially outer lobes 52 having outer peripheral deflecting surfaces 52*a*. The deflector lobe members 48 may have generally the same axial width as the hammer bodies 13 and it will be noted that the peripheral surfaces 52*a* may have the path of rotation previously identified by the letter "z" in FIG. 3 and may radially protect the inner edges 20 of each cutter 15 during operation, along with also protecting or screening the bolts 16 that hold the cutters 15 in fixed position.

Figure 27:
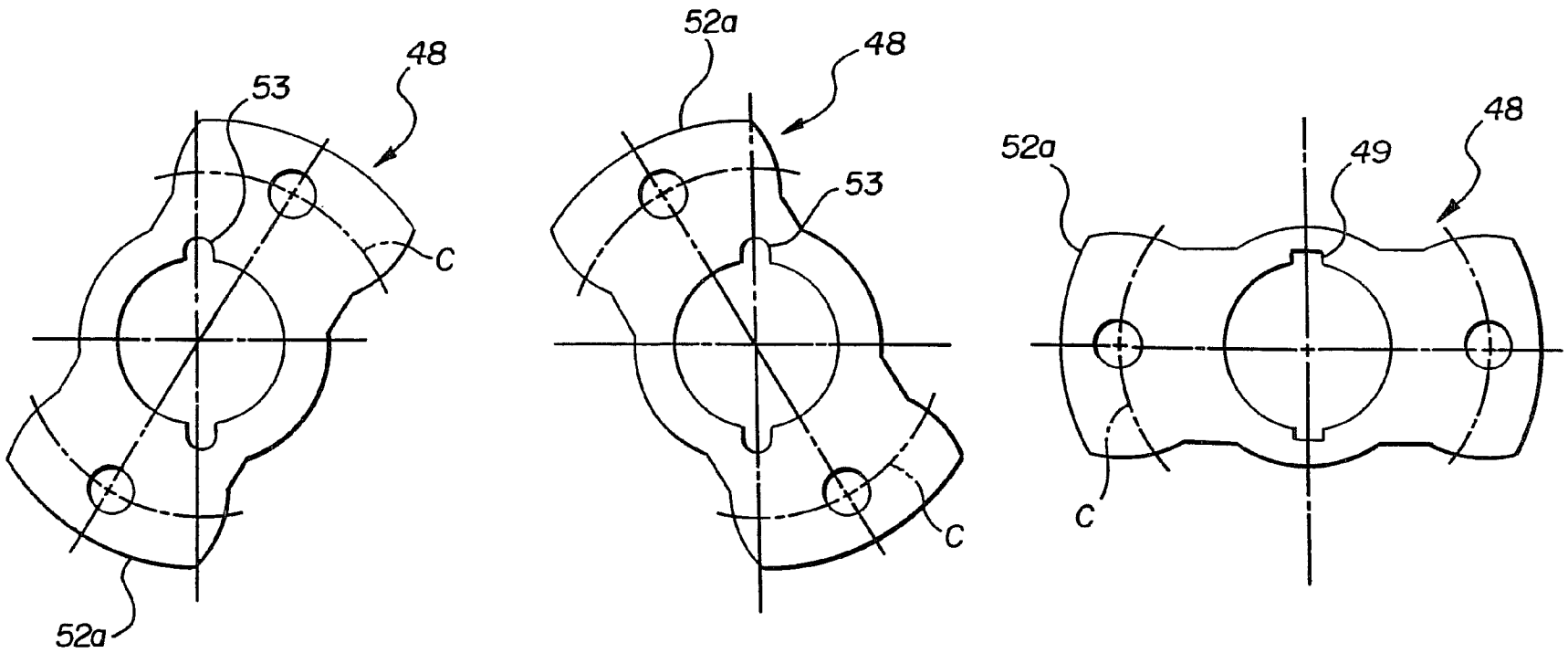
FIG. 27 is a reduced size end elevational view showing deflector elements in the angular relationship in which they are used in the rotor assembly.
Figure 30:
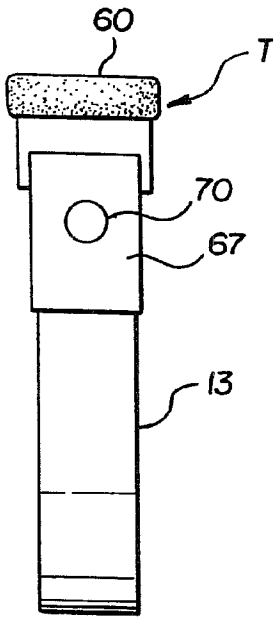
FIG. 30 is a front elevational view.
Figure 29:
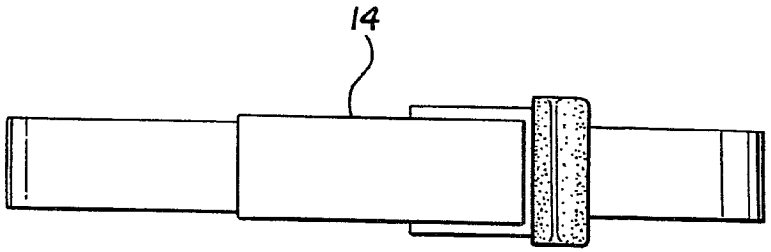
FIG. 29 is a top plan view thereof.

FIG. 27 illustrates a staggered relationship of axially successive deflector lobe members 48. It will be noted that the parts 48 may be identical, with the exception that the horizontal disposed member or element 48 at the right end of FIG. 27 may differ in the configuration of its keyways 29 from the keyway shapes 53 shown in FIG. 27, which, may require axially extending keys of the same configuration to mount them on the shaft portions 10*c*.

In operation, the cutter head assembly, disclosed in FIGS. 23-27, may also be used in either a wood hog or a hammermill and the hammer bodies may operate in the same manner as previously described. With the circumferential path of rotation of the surfaces 52*a*, wood fragments that would otherwise impinge upon the inner edges 20 and/or the bolts 16 are deflected in substantial part by the dual deflector lobe members 48.

Figure 31:
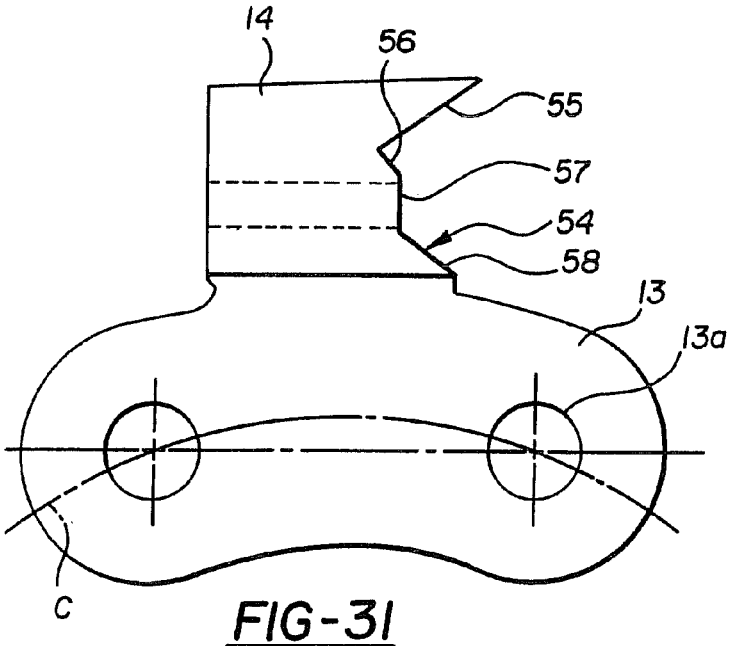
FIG. 31 is an enlarged side elevational view of the rotor body only.
Figure 32:
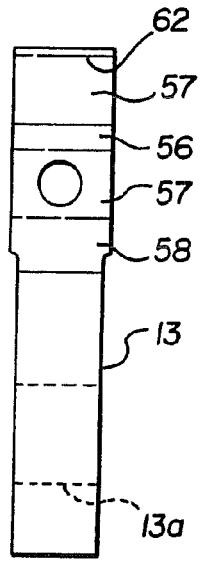
FIG. 32 is a front elevational view.

FIGS. 28-37 are directed to another hammer knife assembly in which, again, like parts have been identified by the same numerals and letters as previously. In this construction, the front or leading face of each hammer head 14, generally designated 54, may be formed with a radially inwardly inclined support surface 55 (FIG. 31) which, for example, can extend at an angle of 125° to the vertical in this figure. A tool base supporting surface 56 leads from surface 55 and can extend at 90° to the surface 55 in FIG. 31. The recessed configuration 54 may also include a vertical surface 57 as shown in FIG. 31, and a clamping surface 58 which, for example, can extend at 128° to the surface 57.

Figure 28:
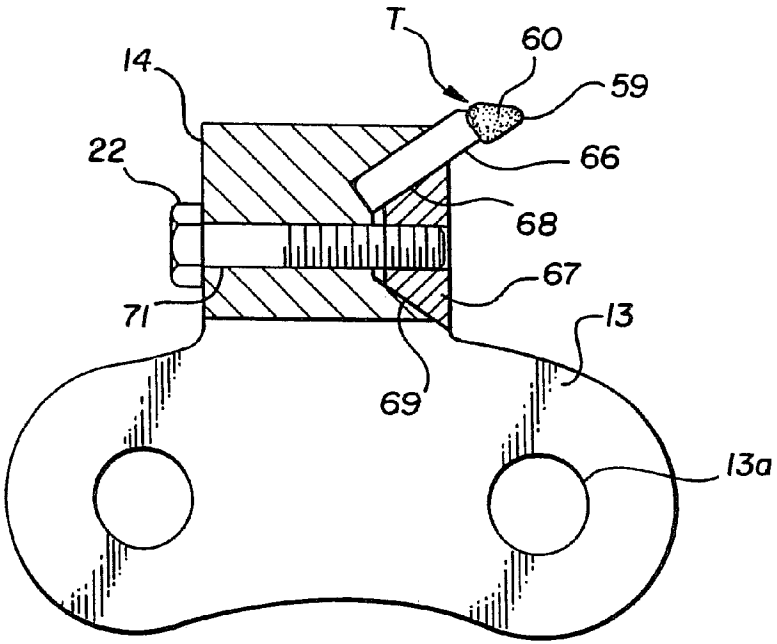
FIG. 28 is an enlarged side elevational view illustrating another embodiment of a hammer and knife assembly.
Figure 33:
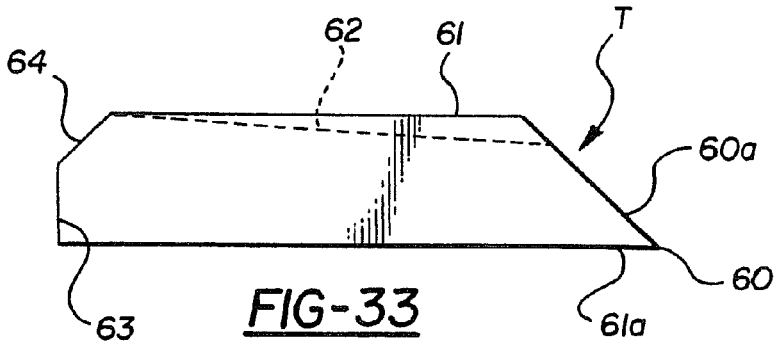
FIG. 33 is an enlarged side elevational view of the knife employed, prior to application of its front end surface coating.
Figure 34:
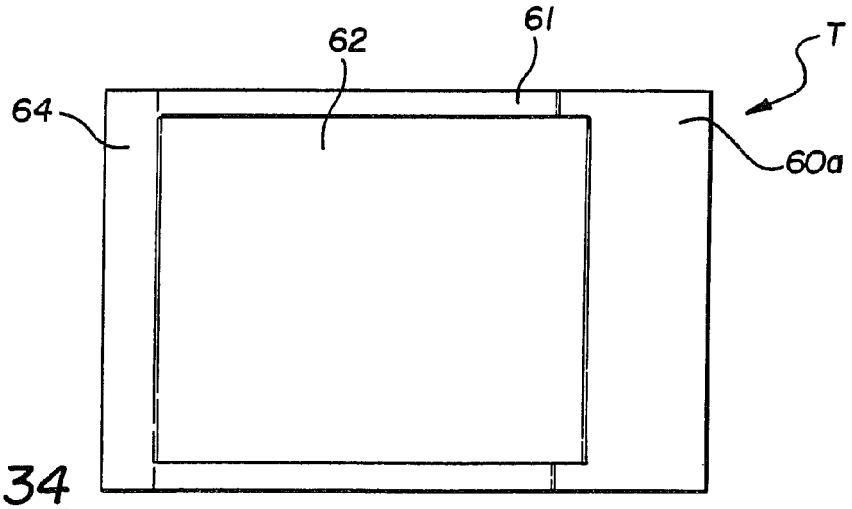
FIG. 34 is a top plan view thereof.

As FIG. 28 illustrates, it is the surfaces 55 and 56 that may receive the fragmenting or cutting tool, generally designated T, which is provided with a hard surfaced coating 59 for cutting tool edge 60. FIGS. 33 and 34 illustrate the configuration of the cutting tool T prior to coating, which is shown as a tool bar in FIGS. 33 and 34 which is cut away at an angle of, for example, 45° from its upper surface 61 as at 60*a* to define the uncoated cutting edge 60. It will be noted that the upper surface 61 of tool bar T may be recessed as at 62 at an inclined relief angle of about, for example, 3° from the surface 61 and that the base end wall 63 at its upper end may be relieved as at 64.

Figure 37:
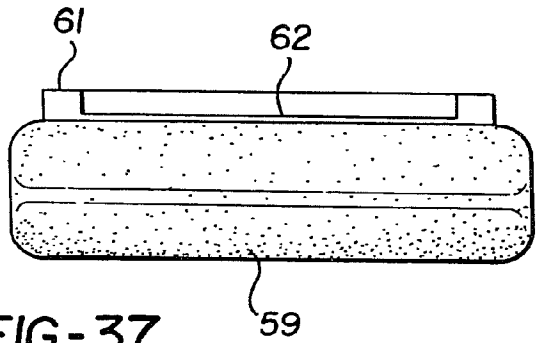
FIG. 37 is a front end elevational view.
Figure 38:
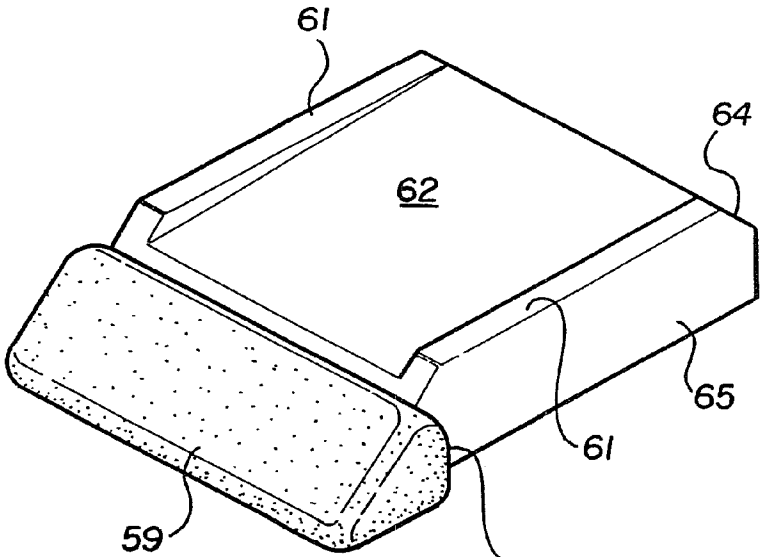
FIG. 38 is a fragmentary perspective view.
Figure 35:
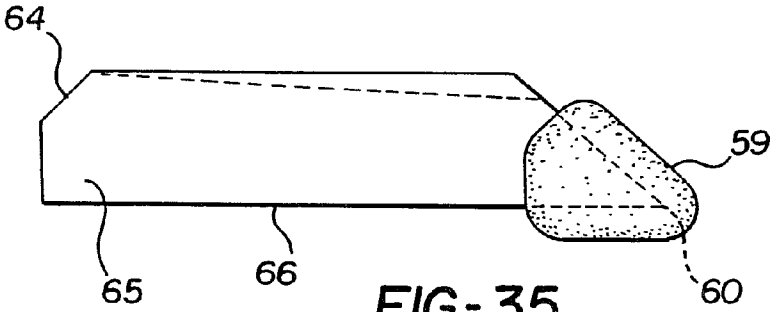
FIG. 35 is a schematic side elevational view of the knife after application of the coating to its front end.
Figure 36:
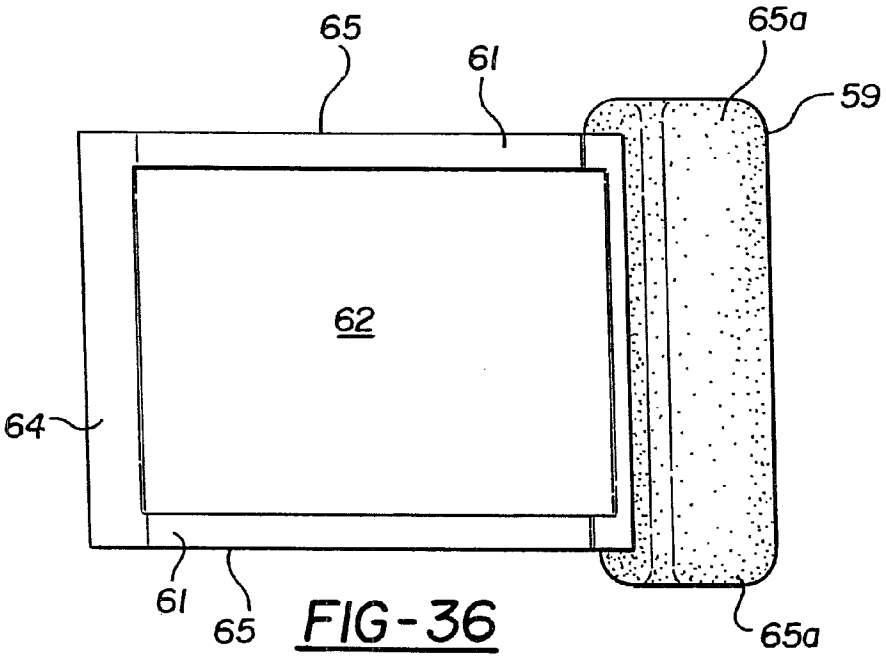
FIG. 36 is a top plan view thereof.

The hard tungsten carbide, or other suitable hard surfaced material, which may be applied to the face 60*a* and cutting edge 60, as shown in FIGS. 35-38, may be about one-eighth inch in thickness. As shown in FIG. 35, the material may coat a major portion of wall surface 60*a* and the front end of bottom surface 66 to protrude from each. The material, likewise, as shown in FIGS. 36 and 37 may project laterally beyond the side walls 65 of the tool bar as at 65*a*. It is the flat outer surface 66 of the toolbar, which may be engaged by the wedge plate 67 (shown in FIGS. 28 and 30). Plate 67 may have oppositely disposed, similarly inclined wedging surfaces 68 and 69, which may respectively engage the toolbar face 66 and the hammer head surface 69 to wedge the toolbar T in rigidly fixed position. A threaded opening 70, which may be provided in wedge plate 67, aligns with a bolt opening 71 through head 14 to receive a bolt 72 which, when revolved in one direction, draws the plate 67 inwardly to tightly clamp toolbar T in position.

In operation, the toolbar T aggressively attacks the wood debris being fragmented or reduced as the rotor assembly RA is revolved at a rapid rate of speed. By loosening bolt 72 and rotating it in the opposite direction, wedge plate 67 may be backed off to permit the ready substitution of a replacement tool T, when wear makes substitution necessary.

FIGS. 39-47 illustrate a still further modified rotor assembly. Where the parts or assemblies are generally the same as previously shown and described, the same numerals and letters have been used to designate them. As before, the rotor assembly RA operates in conjunction with an anvil (not shown). Its drive shaft 10 is shown as journaled in frame supported bearings B supported by machine frame F, and as being driven by a sheave element, generally designated SH, which may be configured to receive motor drive belts in the usual manner. While not previously shown in the drawings, it is to be understood that all of the rotor assemblies shown herein may be journaled and driven in the manner disclosed in FIG. 39.

Fixed in axially spaced relationship along the shaft 10 may be a series of rod-supporting rotor members which may take the form of discs, for example, and which are generally designated 72. As FIG. 40 indicates, the hammer supports or legs 14 may be provided in 180° spaced relation axially adjacent each of the discs 72, on the rods R, which are replaceably mounted as previously disclosed. In the present instance, however, there may be a total of 8 rods disposed in 45° apart circumferential relationship. The rods R may be locked in position by the elements disclosed in FIGS. 19-22.

Figure 41:
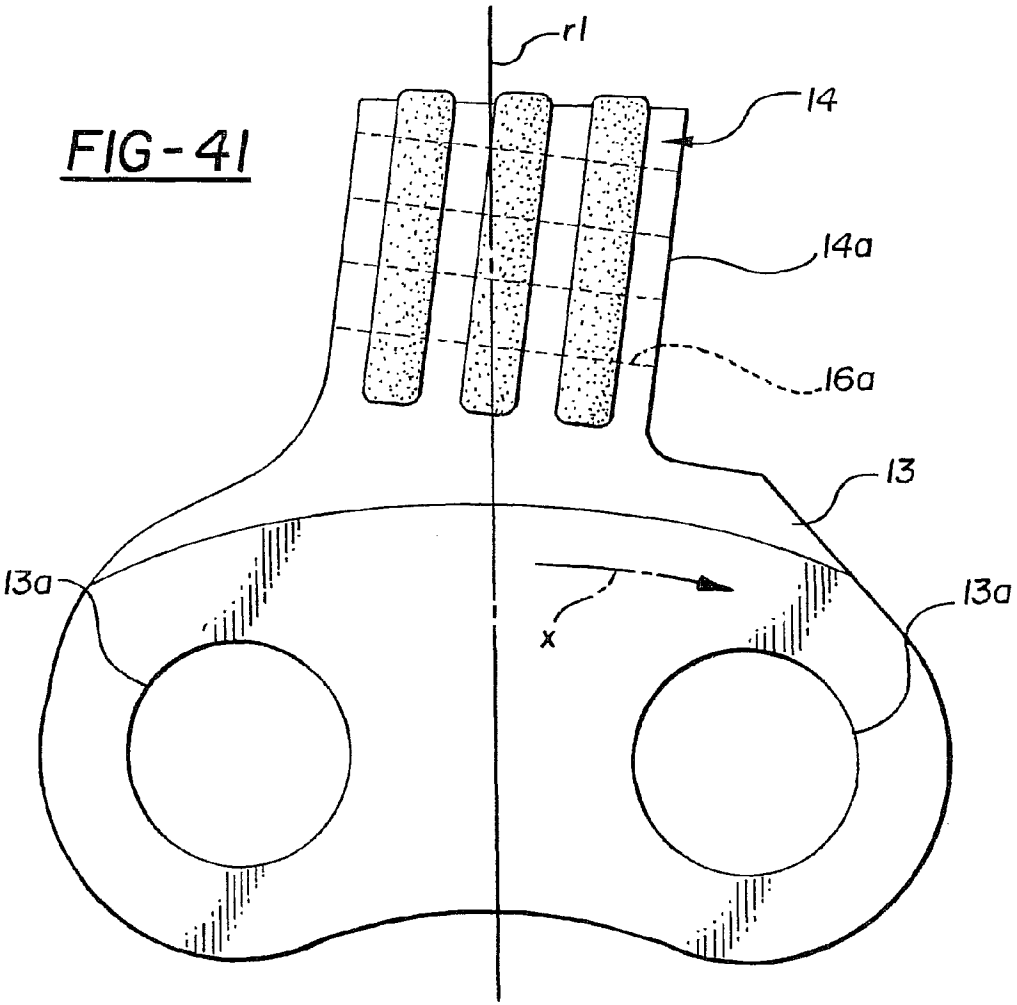
FIG. 41 is an enlarged side elevational view of a modified hammer head used on one side of a rotor disc.
Figure 43:
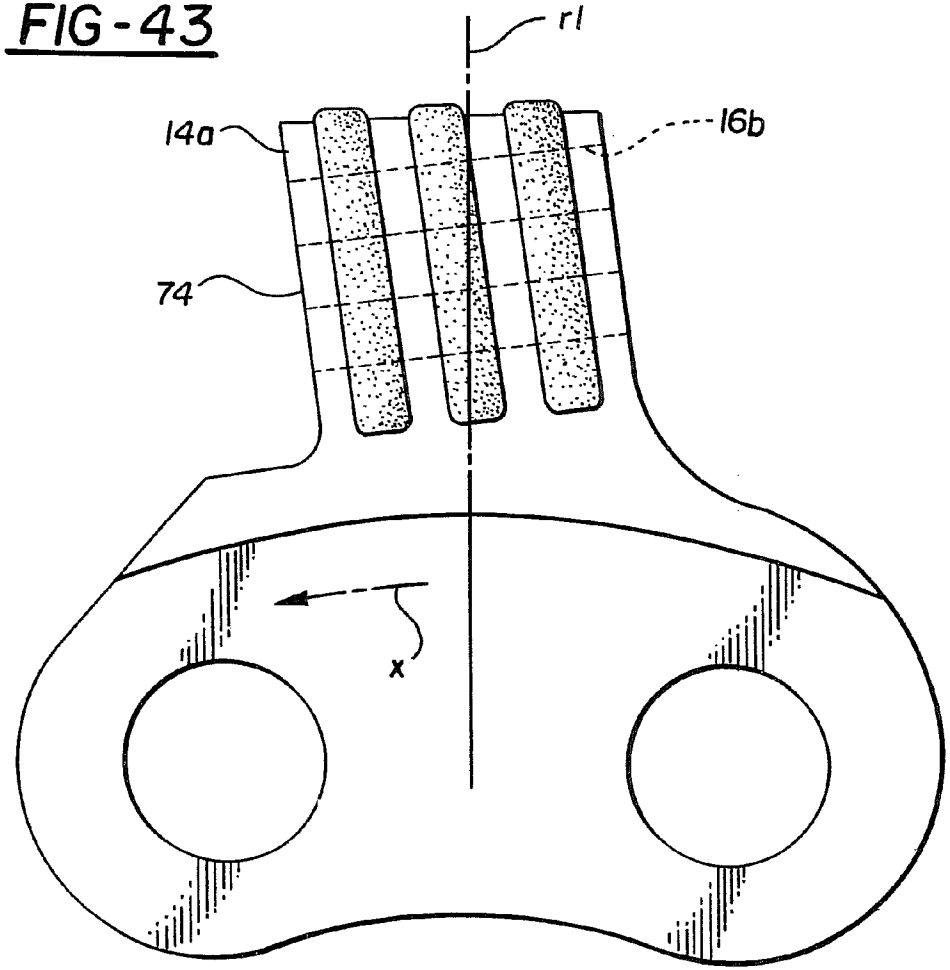
FIG. 43 is a view similar to FIG. 41 of the hammer head used on the other side.

The hammer supports or bodies 14 and knife structures 15 may be of the same constructions as previously set forth in any of the drawing figures with the salient difference in this embodiment, however, that the head portions 14 may tilt forwardly with respect to a radial line rl extending from the axis of rotation "r", in the direction of rotation of the outer knife edge 19. This forward tilt can be readily ascertained by comparing the radial line rl shown in FIG. 40 with the like radial line rl shown in FIG. 41. FIGS. 41 and 43 particularly illustrate this configuration wherein the head portions 14 of the hammers may extend at an angle with respect to the hammer body portions 13. It has been found that with the hammer head in effect tilting forwardly as disclosed a more aggressive bite is obtained by the tilted knife edges. With respect to the hammer heads disclosed in FIGS. 41 and 43, it is to be noted that the body portions 13 may include curvilinear shoulders 73 offset an amount 0 to mate with the periphery of discs 72 and that the angle of inclination of the leading face 74 of each of the heads 14 of the modified embodiment may extend at an angle of approximately 7° to the radial line rl. Otherwise, the hammer heads may remain effectively the same as those disclosed in the first embodiment of the invention.

Figure 45:
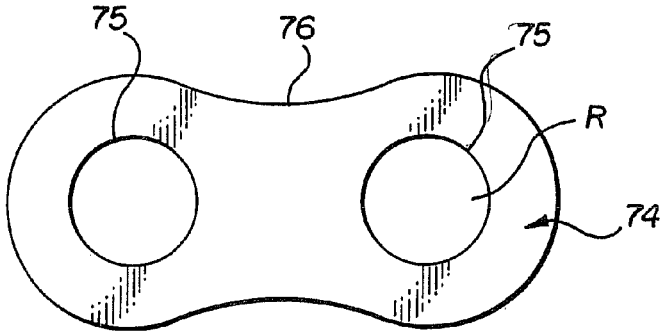
FIG. 45 is an enlarged side elevational view of a modified spacer screening element.

In FIG. 45, a modified form of deflector element or member is disclosed generally at 74. The element 74 may be referred to as generally chain-link configured, and may include openings 75 permitting its mounting on a pair of the circumferentially adjacent rods R in the axial spaces between rotor discs 72 in radial alignment with hammer legs mounted radially outwardly of the discs 72 on rods R. Element or member 74 may also include arcuate surfaces 76 for enabling it to clear the shaft 10. One of the members 74 is shown schematically in position in FIG. 39. It is to be appreciated that each of the pairs or sets of hammers, which are essentially of any of the configurations described herein, may be disposed 180° apart in the spaces between discs 72 as shown and may be successively helically staggered axially. Thus, the position of the respective hammers shown in FIGS. 39, 46, and 46A, in which true axial knife overlap is indicated, may never be reached. These figures are included to illustrate knife path overlap.

Figure 39:
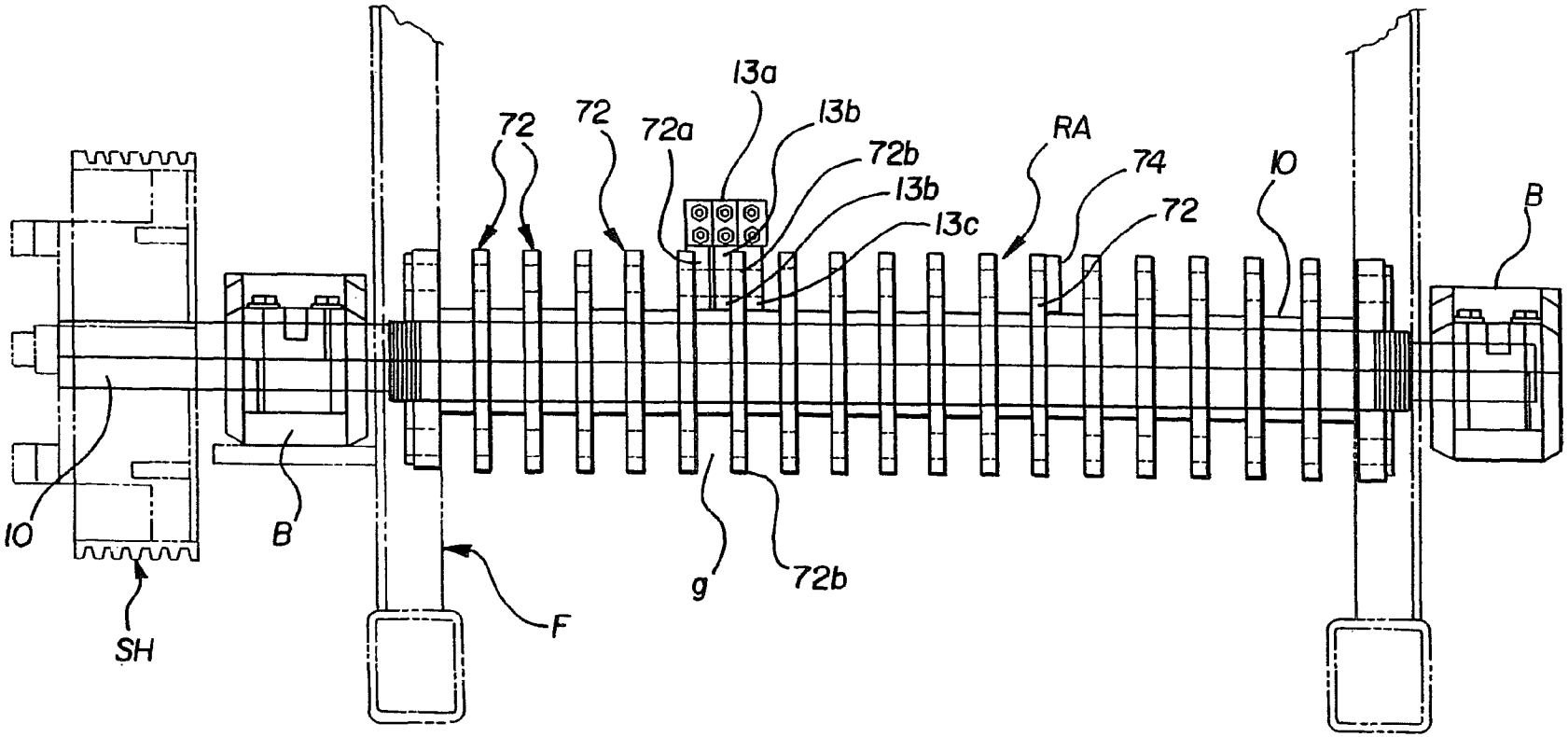
FIG. 39 is a fragmentary schematic plan view of a modified rotor assembly with hammers shown out of position to illustrate how the paths of the knives axially overlap in rotary travel.
Figure 40:
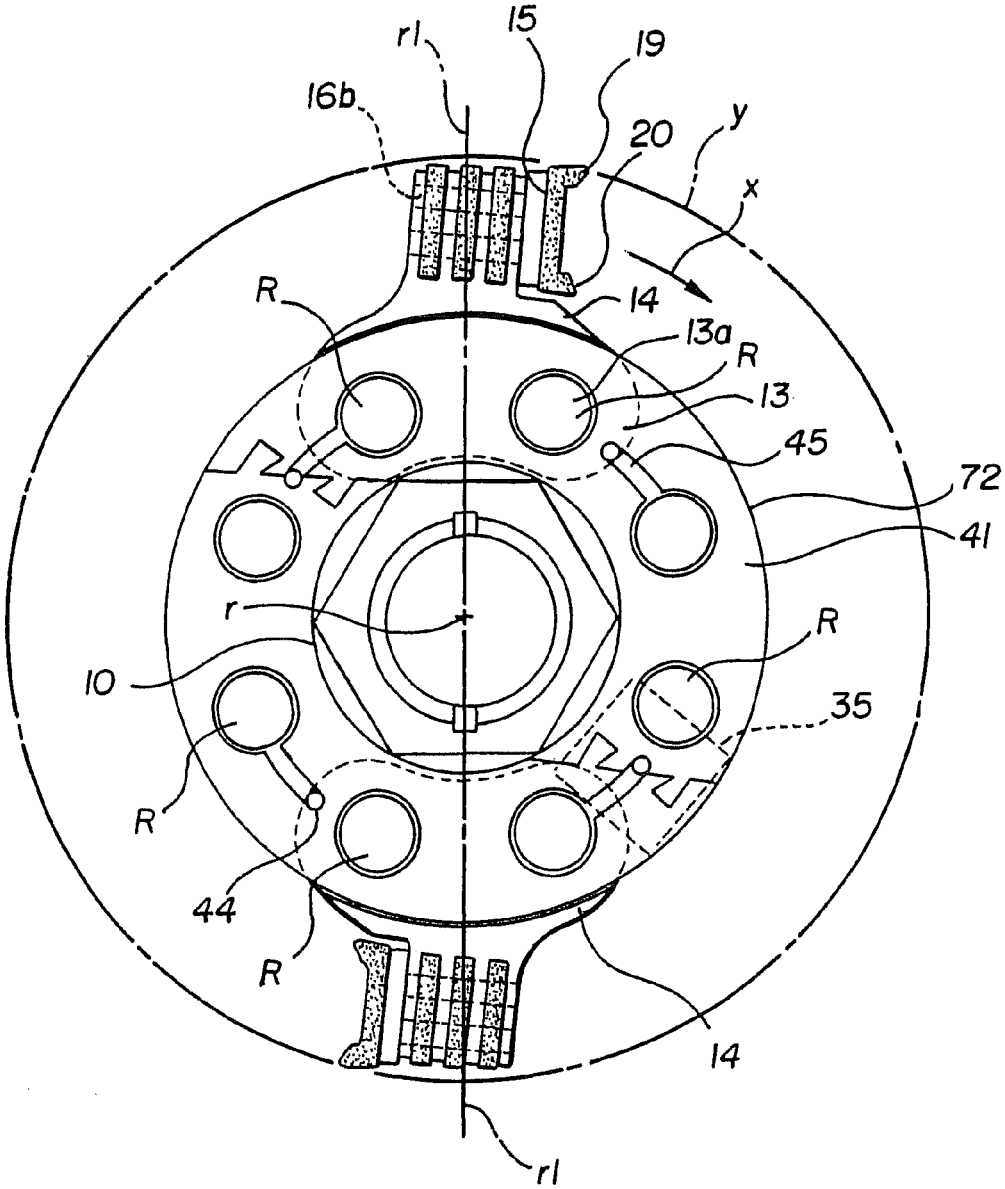
FIG. 40 is an enlarged schematic fragmenting end elevational view showing only a set of hammer heads.
Figure 42:
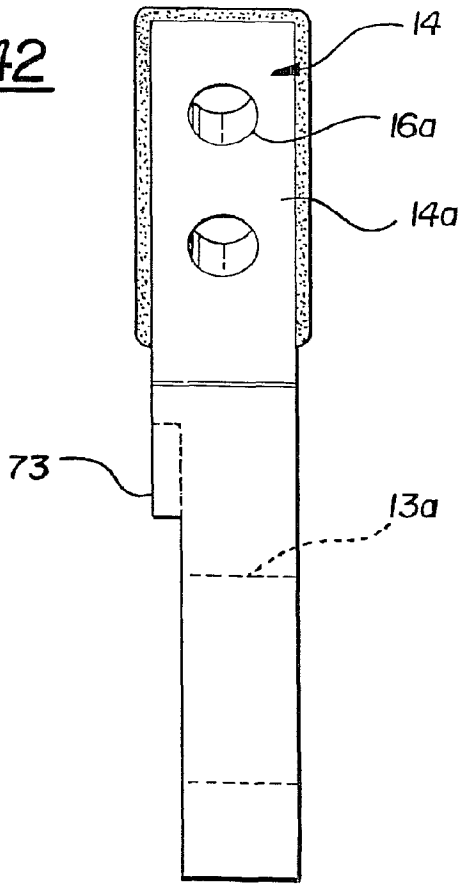
FIG. 42 is an end elevational view thereof.
Figure 46:
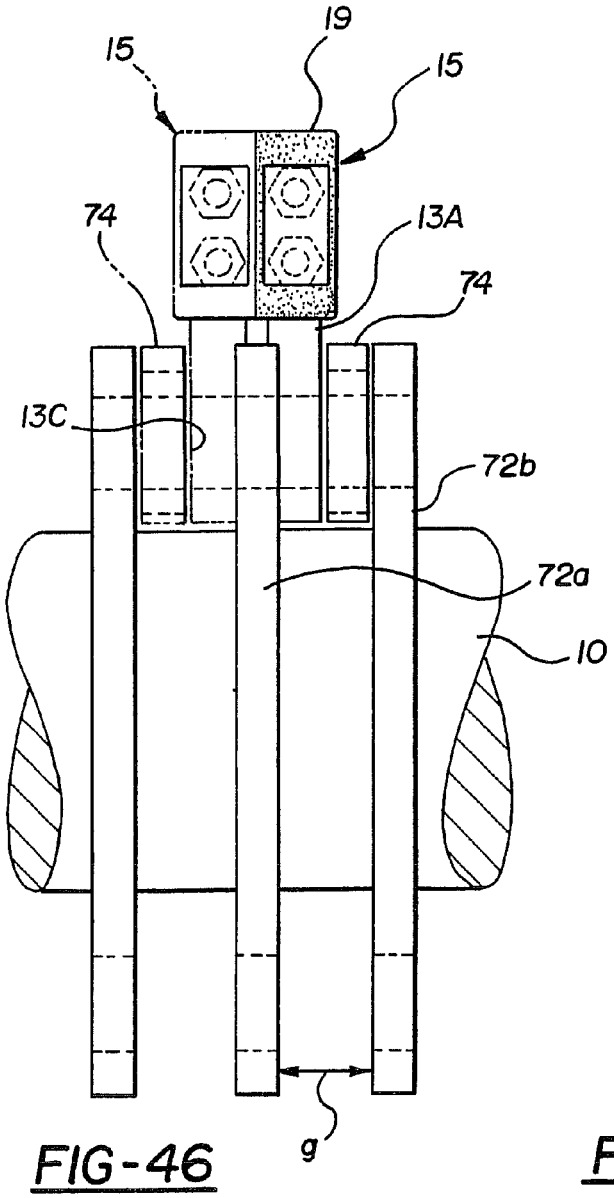
FIG. 46 is a schematic enlarged fragmentary plan view, showing an out of position hammer, which illustrates overlapping travel paths, in broken lines.
Figure 46A:
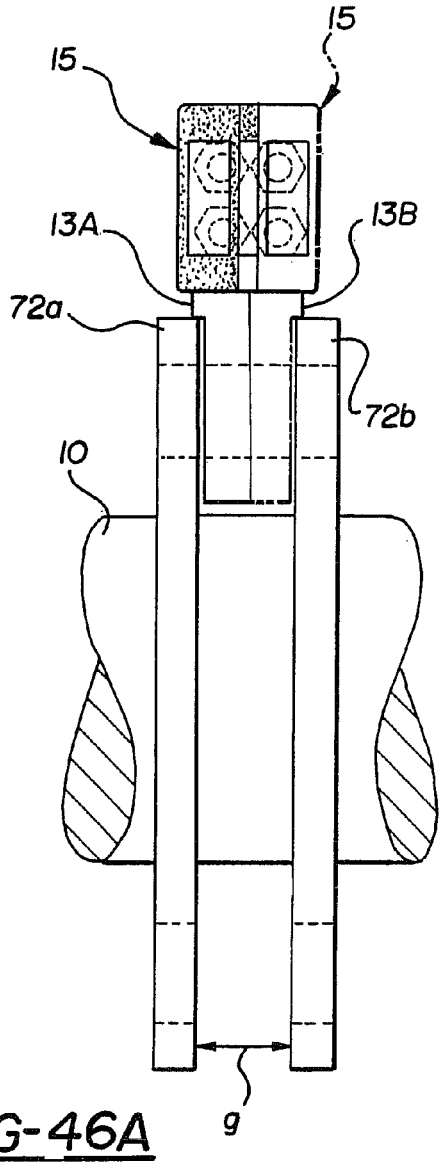
FIG. 46A is a similar view illustrating path overlap.

In FIGS. 39, 46, and 46A, the rotor members involved in these figures have been designated as 72*a* and 72*b*. The hammer supports involved have been designated as 13A, 13B, and 13C. It will be assumed that in FIG. 46A, only the hammer support 13A is shown in its true position. Hammer support 13B is shown in a broken line position and, of course, would truly be circumferentially displaced from hammer body 13A. However, by showing hammer body or support 13B in a rotated position, it is possible to show the three quarter inch axial path overlap that may be achieved.

With particular attention now to FIG. 46 and with the hammer support 13A again being shown in its true position, it is possible to show that when hammer support 13A is in true position, and hammer support 13C is rotated out of true position to the broken line position in FIG. 46, an axial path overlap of a quarter of an inch is achieved. This means that the entire axial surface of the work may be covered during rotation of the knives, which, along the axis r of the rotor assembly, have paths of rotation that may be entirely axially overlapping, while being displaced circumferentially with respect to one another. The overlap may be created by shouldering or insetting the hammer bodies at 73 an amount 0 on one side of the hammer bodies to achieve the overlap desired.

Figure 47:
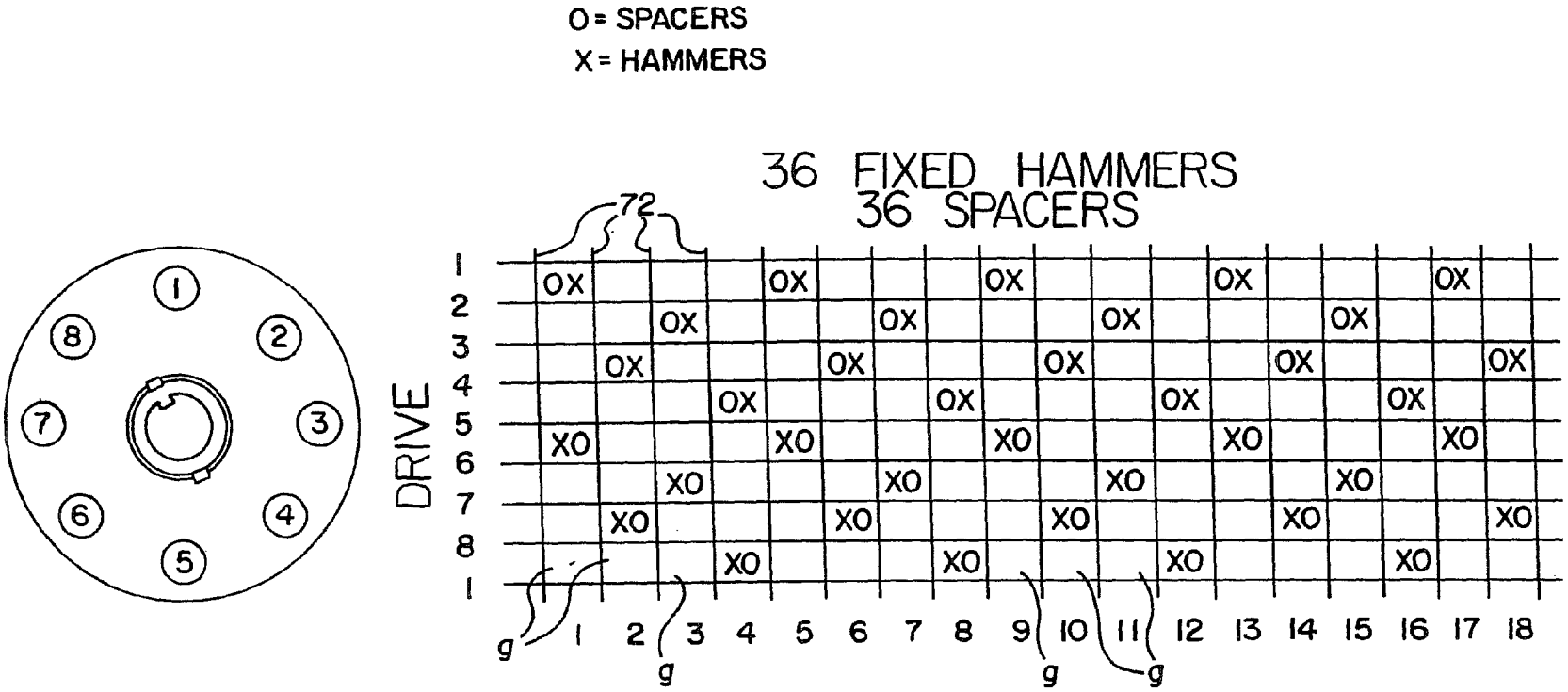
FIG. 47 is a schematic diagram illustrating hammer and spacer disposition along the axial length of the rotor assembly.

The diagram, FIG. 47, illustrating a further arrangement discloses the various rods or support members designated 1-8 at the left end and illustrates these positions in clockwisely arranged vertical position in the hammer-spacer designation part of the diagram. The hammers of FIGS. 46 and 46A are indicated by the letters X and the deflector members 74 termed spacers by the letters O on the diagram, and the disposition of the members 74 and hammers is well indicated in the spaces g between rotor members or the disc or plate representations 72. As will be seen, there may be a deflector member spacer 74 indicated at O for each hammer X and such spacers may be arranged as indicated in the axial spaces g between the rotor discs or spacers 72, which are numbered 1-18. The disposition of the hammers and deflectors 74 circumferentially is portrayed in the diagram. In this embodiment the hammers are not in true radial alignment in the gaps or spaces g.

In operation, the offset tilted hammer heads 14 may operate as previously but may take a more aggressive bite and the cutting edges may have an overlapping path of travel.

Figure 44:
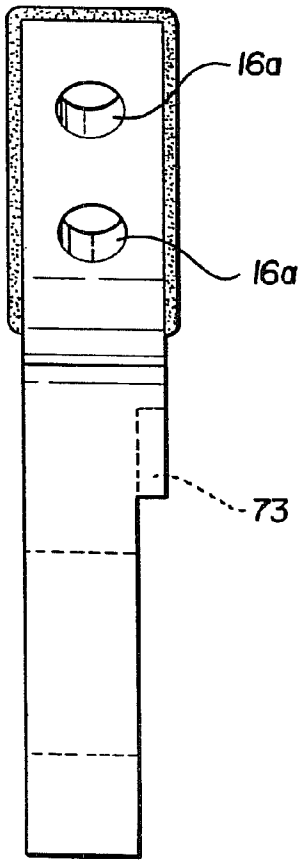
FIG. 44 is an end elevational view thereof.
Figure 51:
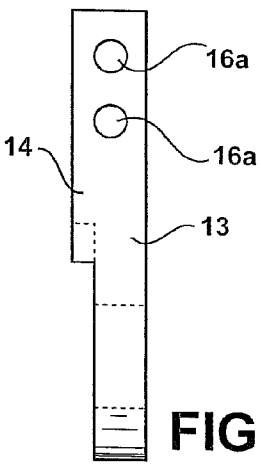
FIG. 51 is an end elevational view thereof.
Figure 50:
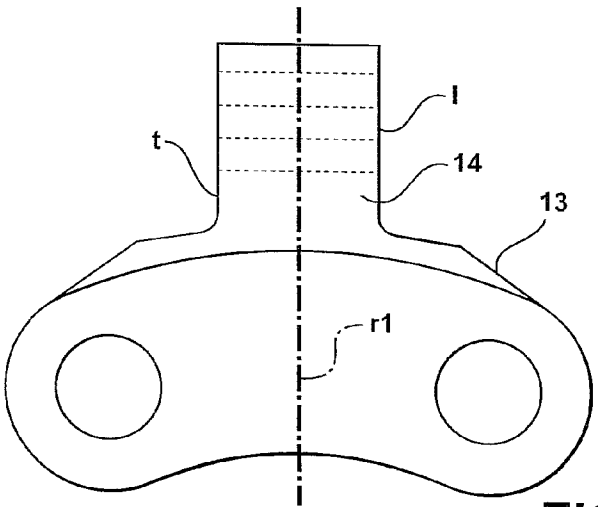
FIG. 50 is an enlarged side elevational view of a typical end reversible hammer head.

In FIGS. 50 and 51, a modified hammer support is disclosed, which may include the same body portion as shown in FIGS. 43 and 44 with the inset or recessed shoulder portion 73. The present hammer support may differ from the forwardly tilted hammer head 14 disclosed in FIGS. 43 and 44 in that it may be symmetric on each side of its center line rl, which is a radial line generally bisecting the axis of shaft 10. In this case, the same pair of rod openings 16*a* may be provided in the hammer support head 14 and the leading and trailing faces 1 and t may be parallel to one another, and parallel to line rl. With this configuration, the knife structure or hammer, generally designated previously as 15, may be mounted on either the face 1 or, if the hammer support is axially reversed, on the face t.

Figure 49:
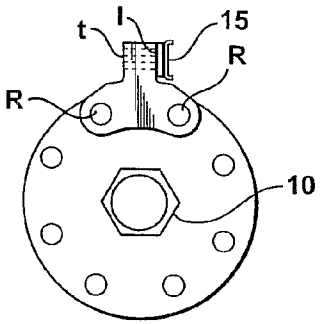
FIG. 49 is a schematic side elevational view of one of the hammer heads with a knife mounted in one cutting position.
Figure 48:
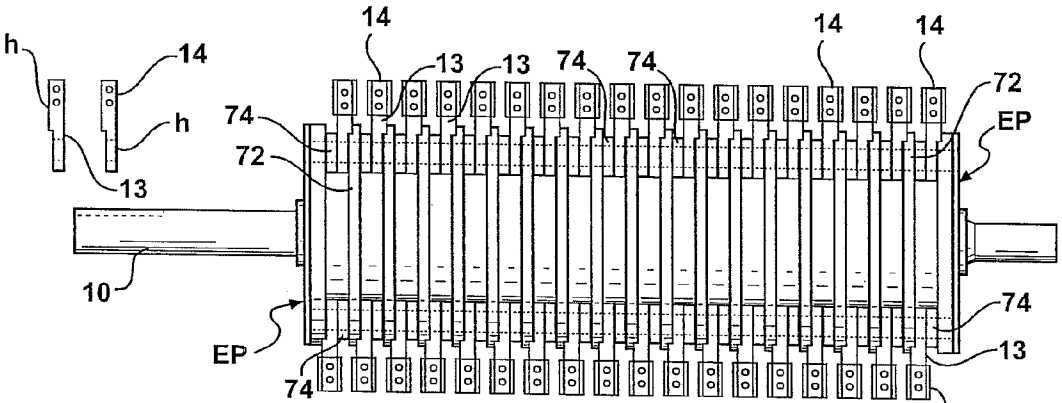
FIG. 48 is a fragmentary, schematic side view of a similar rotor assembly having hammers with heads which can mount knife structures on either of their front and rear faces so that when one face is worn, or there is reason to reverse a hammer head for position in a different array, it can be readily accomplished.

In FIG. 48, each disc or rotor 72 is shown as carrying a pair of hammer supports including an upper hammer support 13 on one side of a disc 72 and a similarly disposed lower hammer support 13 on the opposite side of the disc 72, 180° apart. The deflector members or plates 74 may be provided axially between each hammer support 13 and the adjacent disc or rotor 72, and may also function to hold each hammer support away from the rotor disc 72 it is not to rest against. At the ends of the rotor assembly, it will be noticed that hammer supports 13 may be provided which rest on each end plate assembly, generally designated EP, with the construction disclosed in FIGS. 48 and 49. The hammer supports 13 may be 180° reversible on the rods R, and when their leading faces are worn or damaged, the hammer supports may be reversed in the sense that formerly trailing faces t become the leading faces and the formerly leading faces 1 become the trailing faces. On any one rotor disc, the disposition of the hammer supports may simply be reversed with respect to the disc 72. For example, considering FIG. 48, the upper hammer supports would then be mounted on the rods R to abut the opposite sides of the disc 72 on which they are shown mounted in FIG. 48 and the lower hammer supports 44 simply reversed to mount on the opposite side of the discs 72 on which they are shown in FIG. 48. Also, the position of the reversible plates 74 may be changed to accommodate the new position of the hammer supports and hammers that are driven in rotation by rods R, end plates EP and shaft 10. In FIG. 48, the hammer supports are shown at h in reversed position. While in FIG. 48, only one pair of the hammer supports is shown in 180° spaced relationship, it is to be understood that they may be used in many other desired relationships. For example, in FIG. 49, the rods R are so disposed that two pairs of knives may be provided and the pairs may be disposed in an axially staggered or helical array, as disclosed in previous embodiments in a manner to preserve dynamic balance.

The disclosed embodiment is representative of a presently preferred form of the invention, but is intended to be illustrative rather than definitive thereof. The invention is defined in the claims.

What is claimed is:

1. A fragmenting rotor assembly for comminuting waste wood and other fragmentable material, the assembly comprising:

a drive shaft and mechanism for driving the drive shaft in a direction of rotation about a longitudinal drive shaft axis;

a hammer support carried by the drive shaft and projecting radially relative to the drive shaft axis and including a radially outer hammer head;

a fragmenting knife removably secured to the hammer head and having a reducing edge disposed in a radially outer cutting position; and a deflecting member carried by the drive shaft and having a radially outer end disposed in a position and configured to deflect fragments away from at least a portion of the fragmenting knife, at least one of the hammer support and the deflecting member being carried by at least one rod of a plurality of circumferentially-spaced axially-extending rods that are carried on the drive shaft by axially-spaced rotor members, the deflecting member being disposed adjacent a radial plane of rotation of the hammer head for motion in a circumferential deflecting path radially short of a circumferential cutting path of the reducing edge of the fragmenting knife carried by the hammer head and radially beyond a circumferential path of at least a radially inner portion of the fragmenting knife extending a radial distance short of the radial distance to the fragmenting knife reducing edge;

the fragmenting knife having a second reducing edge and is removably secured to the hammer head such that one of the reducing edges of the knife is positioned in a radially outer cutting position and the other reducing edge of the knife is positioned in a radially inner stowed position relative to the drive shaft axis of rotation;

the radially outer end of the deflecting member being positioned to move in a circumferential deflecting path radially beyond a circumferential path of the fragmenting knife reducing edge carried in the inner stowed position on the hammer head; and the radially outer end of the deflecting member being positioned to move in a circumferential deflecting path radially beyond a circumferential path of one or more bolts holding the fragmenting knife to the hammer head.

2. A fragmenting rotor assembly as defined in claim 1 in which the deflecting member is disposed in the radial plane of rotation of the hammer head.

3. A fragmenting rotor assembly as defined in claim 1 in which:

a plurality of hammer supports and deflecting members are carried by the rods on the drive shaft and are driven in rotation by the drive shaft;

a plurality of fragmenting knives are removably secured to each hammer head of the plurality of hammer supports and have respective reducing edges disposed in respective radially outer cutting positions; and the deflecting members have radially outer ends disposed in respective positions to deflect fragments away from at least portions of respective fragmenting knives.

4. A fragmenting rotor assembly as defined in claim 3 in which the deflecting members are supported in helically staggered positions with respect to the rotational axis of the drive shaft.

5. A fragmenting rotor assembly as defined in claim 1 in which the hammer support is side-for-side reversible.

6. A fragmenting rotor assembly as defined in claim 1 in which the hammer support and the deflecting member are each carried by at least one rod of the plurality of circumferentially-spaced axially-extending rods.

7. A fragmenting rotor assembly for comminuting waste wood and other fragmentable material, the assembly comprising:

a drive shaft and mechanism for driving the drive shaft in a direction of rotation about a longitudinal drive shaft axis;

a hammer support carried by the drive shaft and projecting radially relative to the drive shaft axis and including a radially outer hammer head;

a fragmenting knife removably secured to the hammer head and having a reducing edge disposed in a radially outer cutting position; and a deflecting member carried by the drive shaft and having a radially outer end disposed in a position and configured to deflect fragments away from at least a portion of the fragmenting knife, at least one of the hammer support and the deflecting member being carried by at least one rod of a plurality of circumferentially-spaced axially-extending rods that are carried on the drive shaft by axially-spaced rotor members, the deflecting member having a generally oblong body with a lobular outer end.

8. A fragmenting rotor assembly for comminuting waste wood and other fragmentable material, the assembly comprising:

a drive shaft and mechanism for driving the drive shaft in a direction of rotation about a longitudinal drive shaft axis;

a hammer support carried by the drive shaft and projecting radially relative to the drive shaft axis and including a radially outer hammer head;

a fragmenting knife removably secured to the hammer head and having a reducing edge disposed in a radially outer cutting position; and a deflecting member carried by the drive shaft and having a radially outer end disposed in a position and configured to deflect fragments away from at least a portion of the fragmenting knife, at least one of the hammer support and the deflecting member being carried by at least one rod of a plurality of circumferentially-spaced axially-extending rods that are carried on the drive shaft by axially-spaced rotor members;

the hammer support being carried by two rods of the plurality of rods;

the deflecting member being carried by two rods of the plurality of rods; and at least one of the rods carrying the deflecting member being disposed circumferentially adjacent and rotatively preceding at least one of the two rods carrying the deflecting member.

9. A fragmenting rotor assembly as defined in claim 8 in which both rods carrying the deflecting member rotatively precede both rods carrying the hammer support.

10. A fragmenting rotor assembly as defined in claim 9 in which the hammer support includes two axial through-holes configured to receive two rods of the plurality of axially-extending rods.

11. A fragmenting rotor assembly as defined in claim 9 in which the deflector member includes two axial through-holes configured to receive two rods of the plurality of axially-extending rods.

12. A fragmenting rotor assembly as defined in claim 8 in which the hammer support is carried between two axially adjacent rotor members and the deflecting member is carried between the same two axially adjacent rotor members.

13. A fragmenting rotor assembly as defined in claim 12 in which the deflecting member is spaced radially between the hammer support and a second hammer support carried between the same two axially adjacent rotor members.

14. A fragmenting rotor assembly as defined in claim 13 in which the deflecting member is disposed adjacent a radial plane of rotation of at least one of the two hammer supports carried between the same two axially adjacent rotor members.

15. A fragmenting rotor assembly as defined in claim 14 in which at least a portion of the deflecting member is disposed in the radial plane of rotation of at least one of the two hammer supports.

* * * * *